US011280137B2

(12) United States Patent
Reddy et al.

(10) Patent No.: US 11,280,137 B2
(45) Date of Patent: Mar. 22, 2022

(54) DUAL MAST RIG WITH INDEPENDENTLY ADJUSTABLE PLATFORMS

(71) Applicant: NABORS DRILLING TECHNOLOGIES USA, INC., Houston, TX (US)

(72) Inventors: Padira P. Reddy, Richmond, TX (US); Denver C. Lee, Houston, TX (US)

(73) Assignee: Nabors Drilling Technologies USA, Inc., Houston, TX (US)

( * ) Notice: Subject to any disclaimer, the term of this patent is extended or adjusted under 35 U.S.C. 154(b) by 22 days.

(21) Appl. No.: 16/897,103

(22) Filed: Jun. 9, 2020

(65) Prior Publication Data

US 2020/0392796 A1 Dec. 17, 2020

Related U.S. Application Data

(60) Provisional application No. 62/862,617, filed on Jun. 17, 2019.

(51) Int. Cl.
*E21B 15/00* (2006.01)

(52) U.S. Cl.
CPC ..... *E21B 15/003* (2013.01)

(58) Field of Classification Search
CPC ..... E21B 15/003; E21B 15/02; E21B 17/021
See application file for complete search history.

(56) References Cited

U.S. PATENT DOCUMENTS 4,819,730 A * 4/1989 Williford ..... E21B 7/128 114/144 B
6,047,781 A * 4/2000 Scott ..... E21B 19/002 175/5
6,217,258 B1 * 4/2001 Yamamoto ..... E21B 15/02 175/5
6,481,931 B1 * 11/2002 Welsh ..... E21B 15/02 405/195.1
6,491,477 B2 * 12/2002 Bennett, Jr ..... E21B 15/003 114/265
8,181,697 B2 * 5/2012 Springett ..... E21B 15/003 166/52
8,342,249 B2 * 1/2013 Payne ..... E21B 15/02 166/358
8,387,704 B2 * 3/2013 Rodrigues ..... B63B 35/4413 166/352
2008/0000685 A1 * 1/2008 Humphreys ..... B63B 35/4413 175/5
2008/0302536 A1 * 12/2008 Kotrla ..... E21B 33/064 166/341
2010/0108322 A1 * 5/2010 Eilertsen ..... E21B 15/02 166/352

(Continued)

*Primary Examiner* — Benjamin F Fiorello
(74) *Attorney, Agent, or Firm* — Abel Schillinger, LLP; Enrique Abarca

(57) ABSTRACT

A system for performing a subterranean operation, where the system may include a substructure of a rig configured to move from a first position to a second position, a first platform overlying and coupled to the substructure, a second platform overlying and coupled to the substructure, with the first platform configured to move independently from and relative to the substructure and the second platform, and with the second platform configured to move independently from and relative to the substructure and the first platform.

20 Claims, 23 Drawing Sheets

(56) References Cited

U.S. PATENT DOCUMENTS

| | | | | |
|---|---|---|---|---|
| 2012/0067642 | A1* | 3/2012 | Magnuson | E21B 15/003 175/7 |
| 2013/0101357 | A1* | 4/2013 | Noble | E21B 7/008 405/196 |
| 2015/0034383 | A1* | 2/2015 | Roodenburg | B66C 23/52 175/5 |
| 2016/0090794 | A1* | 3/2016 | Holck | E21B 19/008 166/352 |
| 2018/0282965 | A1* | 10/2018 | Krekel | E21B 15/003 |
| 2019/0136637 | A1* | 5/2019 | Plano | E02B 17/021 |

* cited by examiner

8

DUAL MAST RIG WITH INDEPENDENTLY ADJUSTABLE PLATFORMS

CROSS REFERENCE TO RELATED APPLICATION(S)

This application claims priority under 35 U.S.C. § 119(e) to U.S. Patent Application No. 62/862,617, entitled "DUAL MAST RIG WITH INDEPENDENTLY ADJUSTABLE PLATFORMS," by Padira P. REDDY and Denver C. LEE, filed Jun. 17, 2019, which application is assigned to the current assignee hereof and incorporated herein by reference in its entirety.

BACKGROUND

Embodiments of the present disclosure relate generally to the field of performing subterranean operations with a rig. More particularly, present embodiments relate to a system and method for deploying a dual mast rig with independently adjustable platforms for performing multiple subterranean operations.

When performing drilling or other subterranean operations on an array of wellbores, such as a row of evenly spaced wellbores, or multiple rows of evenly spaced wellbores, some rigs provide two well centers for allowing concurrent operations on two adjacent wellbores in a row of wellbores. However, aligning the two well centers with existing wellbores can prove very cumbersome indeed when the whole rig must move to adjust the position of the well centers with the existing wellbores. Also rigs with two well centers have a fixed distance between the well centers and therefore only a particular spacing of wellbores will allow both well centers to be used for concurrent subterranean operations. Therefore, improvements in dual well center rigs are continually needed.

SUMMARY

In accordance with an aspect of the disclosure, a system for performing a subterranean operation is provided where the system can include a substructure of a rig configured to move from a first position to a second position, a first platform overlying and coupled to the substructure, a second platform overlying and coupled to the substructure, the second platform being different than the first platform, where the first platform is configured to move independently from and relative to the substructure or the second platform, where the second platform is configured to move independently from and relative to the substructure or the first platform. The system may also include movement of the substructure from the first position to the second position includes movement of the first platform and second platform together.

In accordance with another aspect of the disclosure, a method for conducting subterranean operations can include moving, via a rig walker, a rig to a first desired location, the rig comprising a first platform coupled to a substructure and a second platform coupled to the substructure and spacing the second platform from the first platform a desired distance by moving the first platform relative to the second platform.

BRIEF DESCRIPTION OF THE DRAWINGS

These and other features, aspects, and advantages of present embodiments will become better understood when the following detailed description is read with reference to the accompanying drawings in which like characters represent like parts throughout the drawings, wherein.

DETAILED DESCRIPTION

Present embodiments provide a robotic system with electrical components that can operate in hazardous zones (such as a rig floor) during subterranean operations. The robotic system can include a robot and a sealed housing that moves with the robot, with electrical equipment and/or components contained within the sealed housing. The aspects of various embodiments are described in more detail below.

As used herein, the terms "comprises," "comprising," "includes," "including," "has," "having," or any other variation thereof, are intended to cover a non-exclusive inclusion. For example, a process, method, article, or apparatus that comprises a list of features is not necessarily limited only to those features but may include other features not expressly listed or inherent to such process, method, article, or apparatus. Further, unless expressly stated to the contrary, "or" refers to an inclusive-or and not to an exclusive-or. For example, a condition A or B is satisfied by any one of the following: A is true (or present) and B is false (or not present), A is false (or not present) and B is true (or present), and both A and B are true (or present).

The use of "a" or "an" is employed to describe elements and components described herein. This is done merely for convenience and to give a general sense of the scope of the invention. This description should be read to include one or at least one and the singular also includes the plural, or vice versa, unless it is clear that it is meant otherwise.

The use of the word "about", "approximately", or "substantially" is intended to mean that a value of a parameter is close to a stated value or position. However, minor differences may prevent the values or positions from being exactly as stated. Thus, differences of up to ten percent (10%) for the value are reasonable differences from the ideal goal of exactly as described. A significant difference can be when the difference is greater than ten percent (10%).

Figure 1:
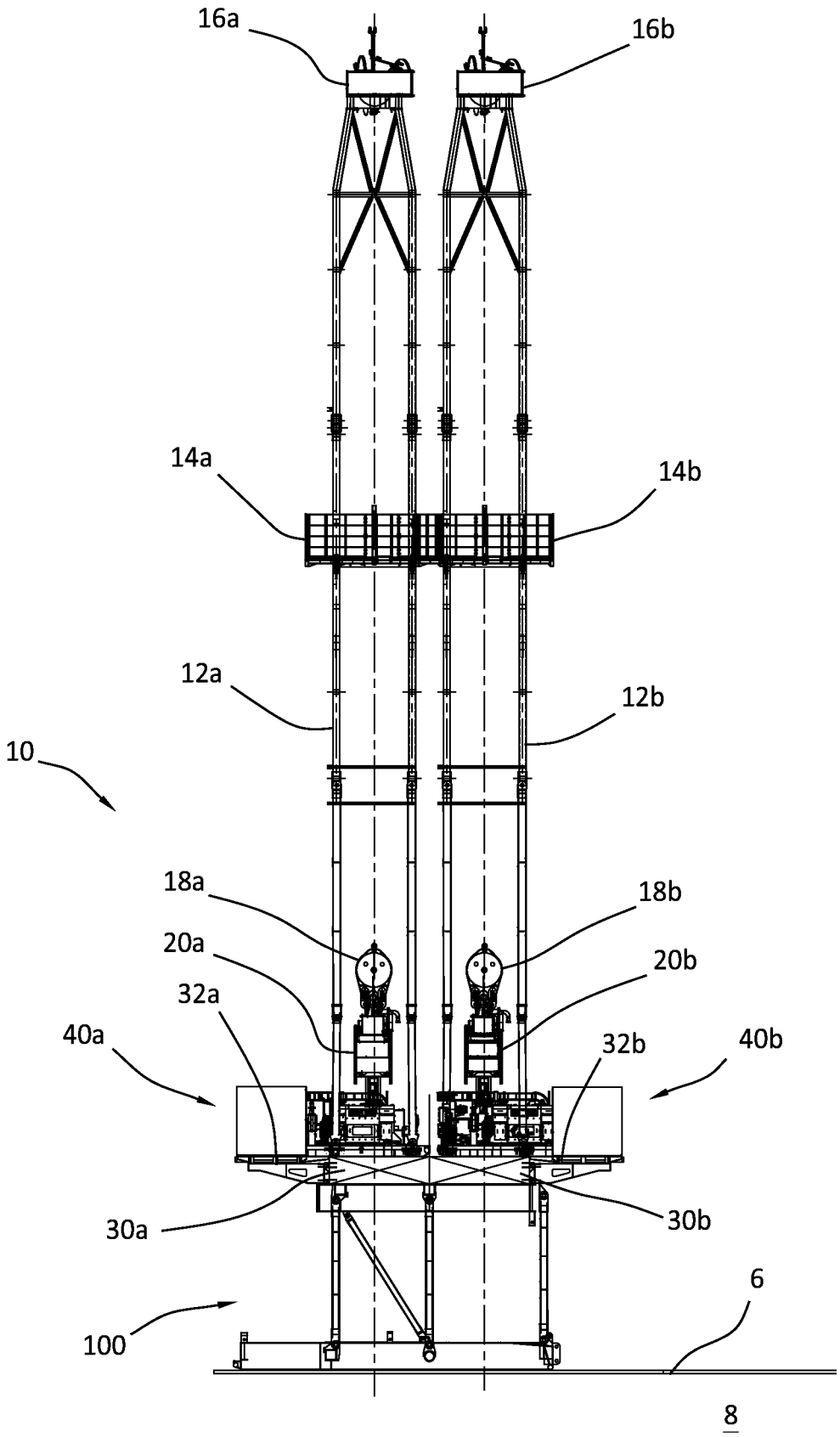
FIG. 1 is a representative front view of a dual mast rig, in accordance with certain embodiments.

FIG. 1 is a representative front view of a rig 10 with two platforms 30*a*, 30*b* coupled to a substructure 100. Each platform 30*a*, 30*b* can include a rig floor 32*a*, 32*b* on which rig floor support equipment 40*a*, 40*b*, respectively, can be installed, as well as a respective derrick 12*a*, 12*b* extending from the rig floor 32*a*, 32*b*. Each derrick 12*a*, 12*b* can include various equipment, for example a fingerboard 14*a*, 14*b*, a top drive 20*a*, 20*b*, a traveling block 18*a*, 18*b*, a crown block 16*a*, 16*b*, as well as other equipment if desired. However, it is not required that the derrick 12*a*, 12*b* includes this equipment. More or fewer equipment can be used to support subterranean operations in an earthen formation 8 through the surface 6, on which the rig 10 can rest. Each derrick 12*a*, 12*b* can be attached to and independently moveable with the respective platform 30*a*, 30*b*, which are independently moveable relative to each other and to the substructure 100 of the rig 10.

Figure 2:
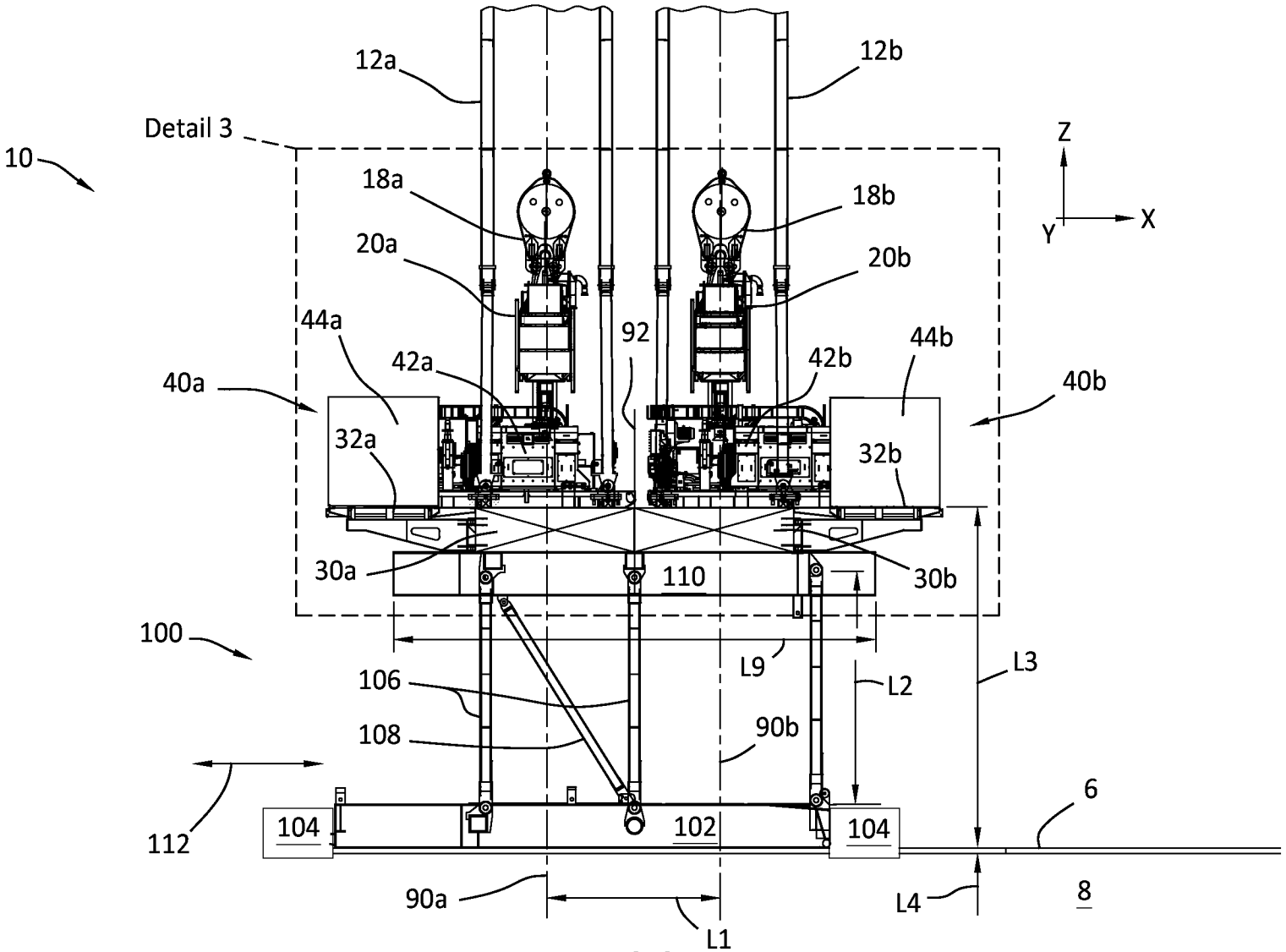
FIG. 2 is a representative front view of a lower portion of a dual mast rig with first and second platforms positioned adjacent each other on a substructure of the rig, in accordance with certain embodiments.

FIG. 2 is a representative front view of a lower portion of the rig 10 with first and second platforms 30*a*, 30*b* positioned adjacent each other on a substructure 100 of the rig 10. The substructure 100 can include a top support structure 110 that is coupled to the platforms 30*a*, 30*b*. The substructure 100 can also include a bottom support structure 102 that can be coupled to a transport system 104, where the transport system can move the bottom support structure 102 along the surface 6 of the earthen formation 8. In particular, the transport system can at least move the bottom support structure 102 (and thus the rig 10) forward and back as indicated by arrows 112, in an X axis direction. By moving the bottom support structure 102 along the surface 6, the entire rig 10 is also moved along the surface to desired locations. The bottom support structure 102 is rotationally coupled to the multiple supports 106 at one end, with the other ends of the multiple supports 106 being rotationally coupled to the top support structure 110.

The rotational coupling of the multiple supports 106 to the top support structure 110 and the bottom support structure 102 allow the top support structures 110 to be lowered and raised as needed to facilitate tear-down and built-up activities, when the rig 10 is moved to another well site. When the top support structure 110 is raised, multiple stabilizer supports 108 can be used to lock the top support structure 110 in the raised position (as seen in FIG. 2). The substructure 100 is shown with three sets of supports 106 of length L2. A height L3 of the rig floors 32*a*, 32*b* from a bottom edge of the bottom support structure 102 can be changed by installing supports 106 of various lengths L2, as long as all supports 106 are substantially the same length. A length L4 can indicate a clearance from the bottom of the bottom support structure 102 to the surface 6, where this clearance can be necessary for the transport system 104 to move the rig 10.

The substructure 100 can also be built wider in the X axis direction by extending the length L9 of the top support structure 110 and correspondingly extending the length of the bottom support structure 102. Depending upon the length L9 of the top support structure 110, additional supports 106 can be installed to provide additional support for the top support structure 110. The increasing the length L9 can allow the platforms 30*a*, 30*b* to be moved further apart as needed to support dual operations of the dual mast rig 10.

The X-Y-Z coordinate system indicated in FIG. 2 is referenced to the rig floors 32*a*, 32*b*, and is given as reference for discussion purposes only. A different relative coordinate system can be used, if desired. The X-Y-Z coordinate system in several of the FIGS. has the X axis parallel to the rig floors 32*a*, 32*b* and extending left and right as viewed in FIG. 2. The Y axis is perpendicular to the X axis and parallel to the rig floors 32*a*, 32*b*. Therefore, an X-Y plane would be parallel to the rig floors 32*a*, 32*b*. The Y-axis is indicated as coming out of and going into the view of FIG. 2. The Z axis is perpendicular to both the X and Y axes, and is shown in FIG. 2 as being up and down from the X-Y plane.

The platforms 30*a*, 30*b* can be moveably coupled to the top support structure 110 of the substructure 100. Increasing the length L9 can allow the platforms 30*a*, 30*b* to be moved further apart as needed to support dual operations of the dual mast rig 10. Each platform 30*a*, 30*b* can include various rig floor equipment 40*a*, 40*b*, such as a drillers cabin 44*a*, 44*b*, a drawworks 42*a*, 42*b*, a vertical pipe handler (not shown), a choke manifold (not shown), etc. It should also be understood that some of this equipment can be common between the platforms 30*a*, 30*b*. For example, one drillers cabin 44*a* can be used to observe, monitor, and control the operations being performed on both platforms 30*a*, 30*b*, instead of having separate drillers cabin 44*a*, 44*b* for each platform 30*a*, 30*b*.

The platforms 30*a*, 30*b* are shown abutting each other on the substructure 100 at the center line 92 of the top support structure 110. This positioning of the platforms 30*a*, 30*b* can produce a wellbore spacing L1 that can indicate a relative position of adjacent wellbores in a wellbore array (the array can be a row of multiple wellbores as well as multiple rows of multiple wellbores). Therefore, if both of the platforms 30*a*, 30*b* are used to drill or work a pair of wellbores, the wellbores would be a distance of length L1 from well center to well center. However, it is possible to have one or more wellbore locations between the pair of wellbores aligned with well centers of the platforms 30*a*, 30*b*. Preferably, a wellbore spacing of the wellbores in the wellbore array would be the length L1, with the rig 10 being moved a length L1 each time the next wellbore is to be worked. However, if the rig is moved forward or backward (see arrows 112) a different distance (e.g. ⅓ of L1, or ½ of L1) then a smaller pitch of the wellbores in the wellbore array can be achieved. Larger wellbore spacing can be achieved by moving the platforms 30*a*, 30*b* away from each other on the substructure 100. This will be explained in more detail in the following description.

Figure 3:
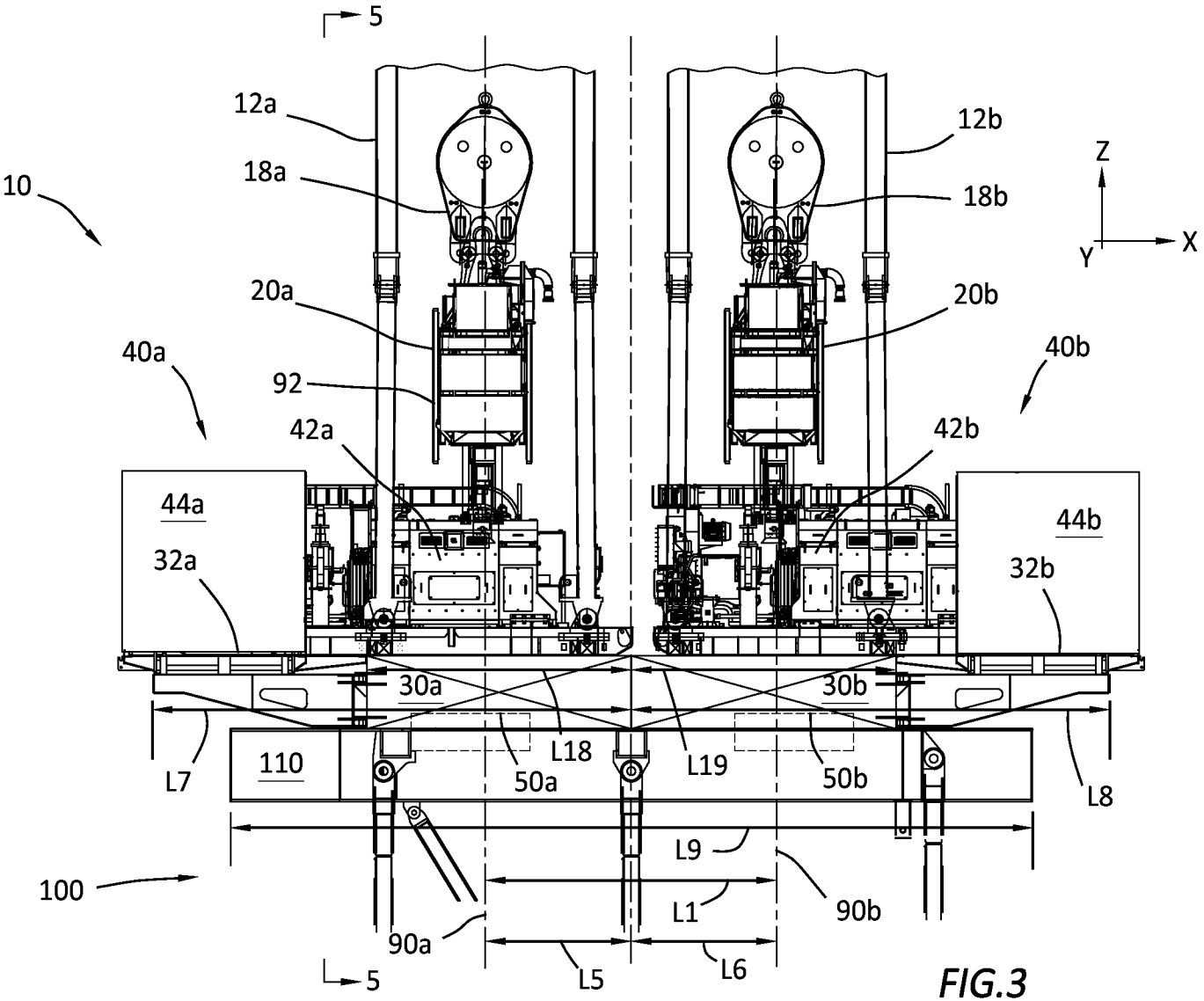
FIG. 3 is a representative front view of a detail portion 3 of the dual mast rig in FIG. 2 with first and second platforms positioned adjacent each other on a substructure of the rig, in accordance with certain embodiments.

FIG. 3 is a representative front view of a detail portion 3 of the dual mast rig 10 in FIG. 2 with platforms 30*a*, 30*b* positioned adjacent each other on a substructure 100 of the rig 10 at the center 92 of the top support structure 110. The width of each one of the platforms 30*a*, 30*b* is shown as L18, L19, respectively. This width L18, L19 includes the structure that supports the derrick 12*a*, 12*b* on each respective platform 30*a*, 30*b*, but not the extended structure that supports the drillers cabin 44*a*, 44*b*. The width L7, L8 is the width of the respective platform 30*a*, 30*b* that includes the extended structure. The well centers 90*a*, 90*b* of the respective platform 30*a*, 30*b* are spaced the length L1 away from each other. The well center 90*a* of the platform 30*a* can be spaced away from the center 92 by a length L5. The well center 90*b* of the platform 30*b* can be spaced away from the center 92 by a length L6.

A drive system 50*a* can be coupled between the substructure 100 and the platform 30*a* and configured to move the platform 30*a* relative to the substructure 100 in both the X and Y directions. These drive systems can include hydraulic actuators coupled to a skid plate system, a cable and pulley system with motors driving the cables through a pulley system coupled to a skid plate system, a screw-type drive system coupled to a skid system, as well as other suitable drive systems that can move the platform 30*a* relative to the substructure 100. A drive system 50*b* can be coupled between the substructure 100 and the platform 30*b* and configured to move the platform 30*b* relative to the substructure 100 in both the X and Y directions. These drive systems can include hydraulic actuators coupled to a skid plate system, a cable and pulley system with motors driving the cables through a pulley system coupled to a skid plate system, a screw-type drive system coupled to a skid system, as well as other suitable drive systems that can move the platform 30*b* relative to the substructure 100.

Figure 4:
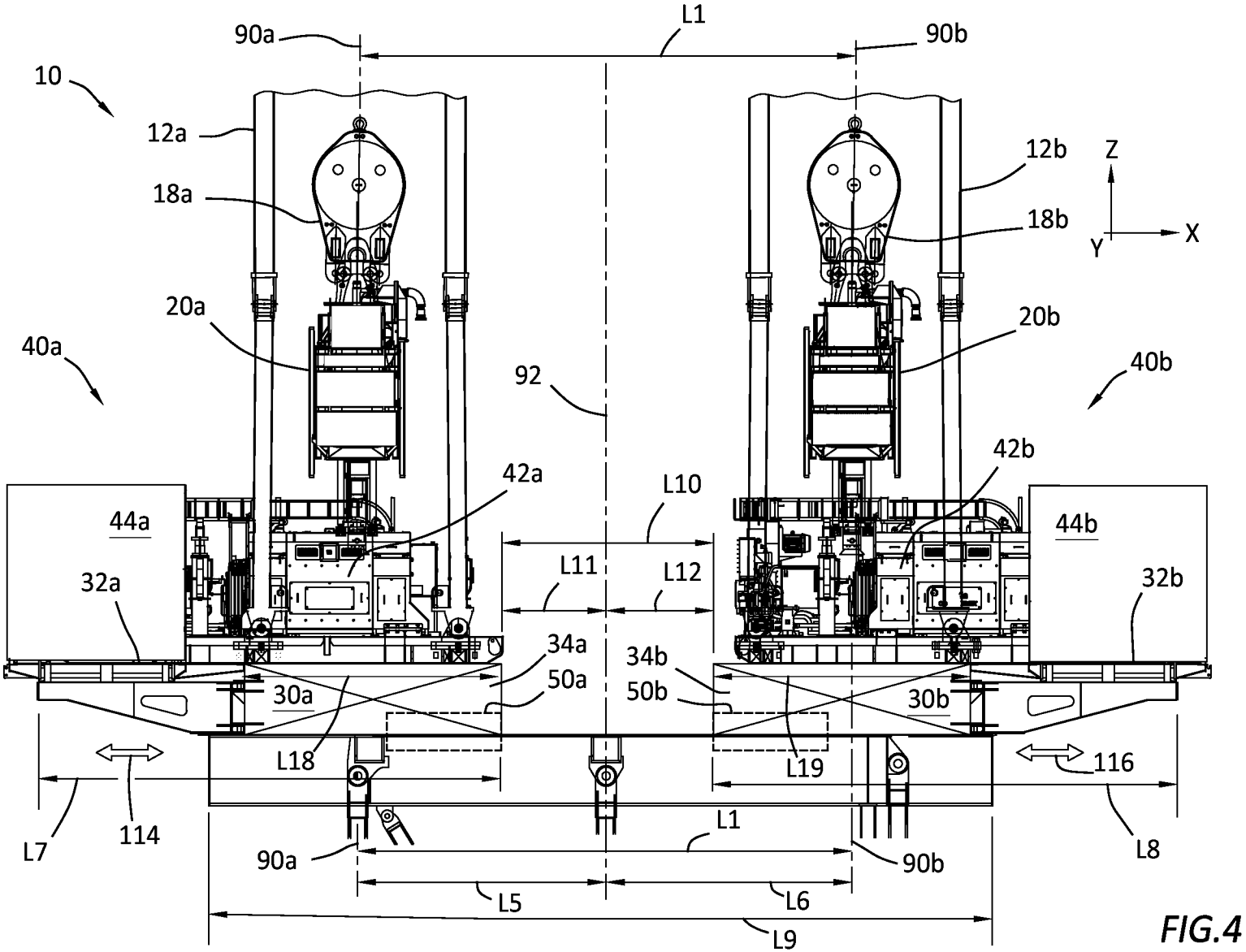
FIG. 4 is a representative front view of a lower portion of a dual mast rig with first and second platforms spaced apart from each other on a substructure of the rig, in accordance with certain embodiments.

FIG. 4 is a representative front view of a detail portion 3 of the dual mast rig 10 in FIG. 2 with the platforms 30*a*, 30*b* spaced apart from each other on the substructure 100. The drive systems 50*a*, 50*b* are configured to move the respective platform 30*a*, 30*b* at least in the X axis direction as indicated by arrows 114, 116, respectively. In FIG. 4, the drive system 50*a* has moved the platform 30*a* a distance L11 from the center 92, and the drive system 50*b* has moved the platform 30*b* a distance L12 from the center 92. The drive systems 50*a*, 50*b* operate independently so the platforms 30*a*, 30*b* can be moved independently from each other. The platform 30*a* can be moved the distance L11 from the center 92, which in FIG. 4 is approximately 40% of the width of the platform 30*a*. However, as stated above, the top support structure 110 can be made wider than the length L9 shown in FIG. 4.

By increasing the length L9 of the top support structure 110, the platforms 30*a*, 30*b* can be moved further apart from each other. A wider top support structure 110 can allow the platform 30*a* to be moved further with the distance L11 being up to 100% of the width L18 of the platform 30*a*. Therefore, the distance L11 can be up to 100%, up to 95%, up to 90%, up to 85%, up to 80%, up to 75%, up to 70%, up to 65%, up to 60%, up to 55%, up to 50%, up to 45%, up to 40%, up to 35%, up to 30%, up to 35%, up to 30%, up to 25%, up to 20%, up to 15%, up to 10%, or up to 5% of the width L18. A wider top support structure 110 can allow the platform 30*b* to be moved further with the distance L12 being up to 100% of the width L19 of the platform 30*b*. Therefore, the distance L12 can be up to 100%, up to 95%, up to 90%, up to 85%, up to 80%, up to 75%, up to 70%, up to 65%, up to 60%, up to 55%, up to 50%, up to 45%, up to 40%, up to 35%, up to 30%, up to 35%, up to 30%, up to 25%, up to 20%, up to 15%, up to 10%, or up to 5% of the width L19. The length L10 is a distance between the platforms 30*a*, 30*b* when they are separated, with the length L10 being equal to length L11 plus length L12.

The well centers 90*a*, 90*b* of the respective platform 30*a*, 30*b* are spaced the length L1 away from each other. The well center 90*a* of the platform 30*a* can be spaced away from the center 92 by a length L5. The well center 90*b* of the platform 30*b* can be spaced away from the center 92 by a length L6. Each platform 30*a*, 30*b* has a front edge 34*a*, 34*b*.

Figure 5:
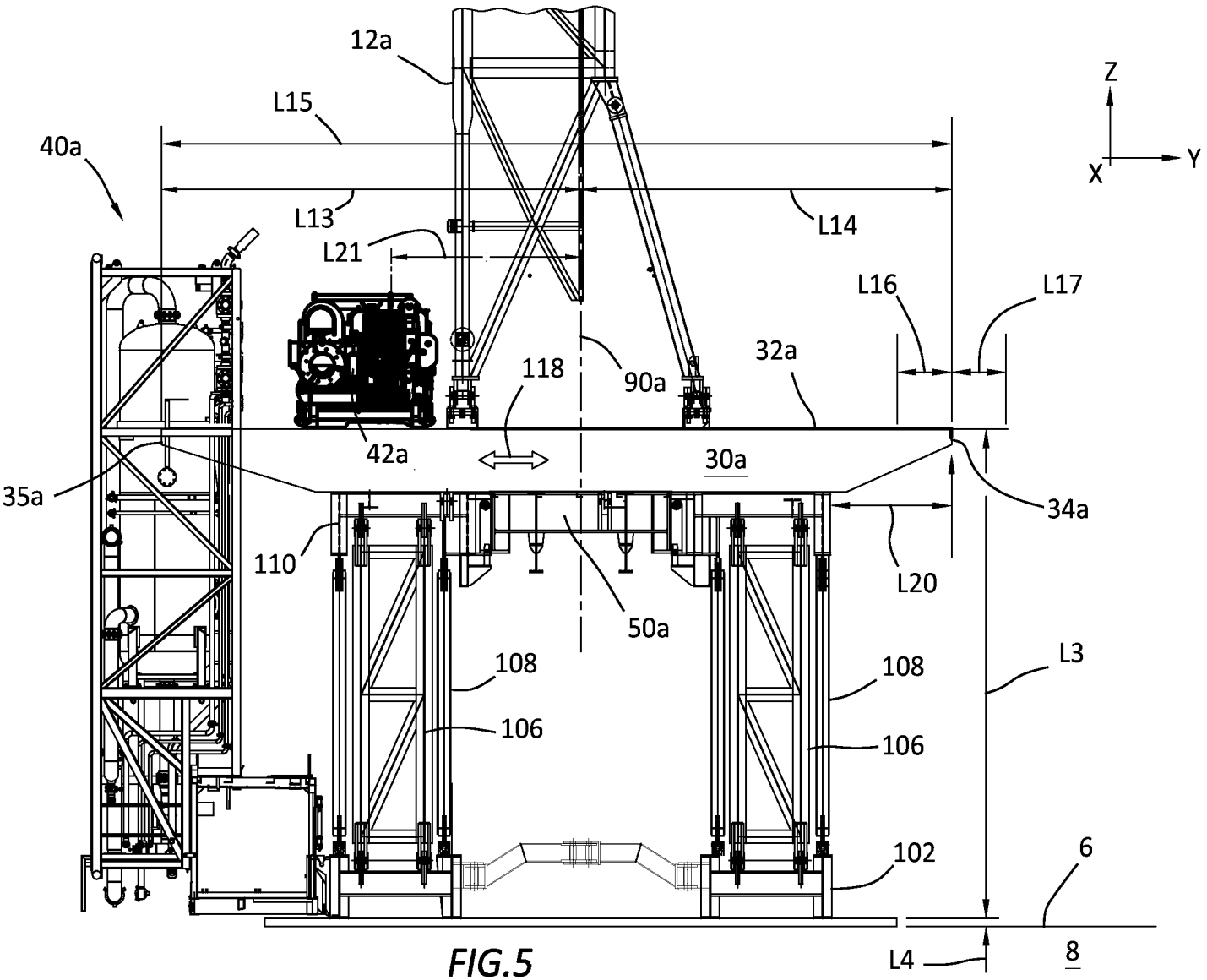
FIG. 5 is a representative side view along line 5-5 of the dual mast rig of FIG. 3, in accordance with certain embodiments.

FIG. 5 is a representative side view of the rig 10 as seen along line 5-5 in FIG. 3. A possible configuration of the supports 106 and stabilizers 108 between the top and bottom support structures 110, 102 are shown in the raised position of the rig 10. As stated above, the drive systems 50*a*, 50*b* can move the respective platforms 30*a*, 30*b* in both the X axis and Y axis directions. FIG. 4 shows the possible movements in the X axis direction. FIG. 5 shows the possible movements in the Y axis direction (arrows 118) for the platform 30*a*, and the description similarly applies to the platform 30*b*, where the drive means 50*b* can move the platform 30*b* in the Y axis direction. The length L15 is a length of a side of the platform 30*a* in the Y axis direction. The length L13 is a distance from the well center 90*a* to a back edge 35 of the platform 30*a*. The length L14 is a distance from the well center 90*a* to a front edge 34*a* of the platform 30*a*. The length L20 is a distance from the front edge 34*a* and the top support structure 110 of the substructure 100. The drive system 50*a* can coupled between the platform 30*a* and the substructure 100 as described above to move the platform 30*a*. The drive system 50*a* can move the platform 30*a* a length L16 in a Y axis direction toward the rear of the rig 10, and can move the platform 30*a* a length L17 in a Y axis direction toward the front of the rig 10. Therefore, the length L20 can be reduced by the length L16 or increased by the length L17. The lengths L16, L17 can be up to 20%, up to 19%, up to 18%, up to 17%, up to 16%, up to 15%, up to 14%, up to 13%, up to 12%, up to 11%, up to 10%, up to 9%, up to 8%, up to 7%, up to 6%, up to 5%, up to 4%, up to 3%, up to 2%, or up to 1% of the length L15 of the side of the platform 306*a*.

With both platforms 30*a*, 30*b* being independently moveable relative to each other and the substructure 100, the rig has the unique ability to align the well center 90*a*, 90*b* of its respective platform 30*a*, 30*b* to a desired wellbore location or an existing wellbore location, without necessarily having to move the rig 10. For example, moving the entire rig 10 may not result in each well center 90*a*, 90*b* being properly aligned to a desired wellbore location. The moveable platforms 30*a*, 30*b* allow each drive system 50*a*, 50*b* to move its respective platform 30*a*, 30*b* in the X-Y plane to provide a final alignment of the well centers 90*a*, 90*b* to the desired wellbore locations. FIGS. 6A-6G, and 7A-7F illustrate how the independent adjustments of the platforms 30*a*, 30*b* can be beneficial in working on wellbore arrays.

FIGS. 6A-6G are representative partial cross-sectional front views of a dual mast rig 10 performing sequential operations on consecutive wellbore locations 60 in a wellbore array 62 at a first wellbore spacing L1.

Figure 6A:
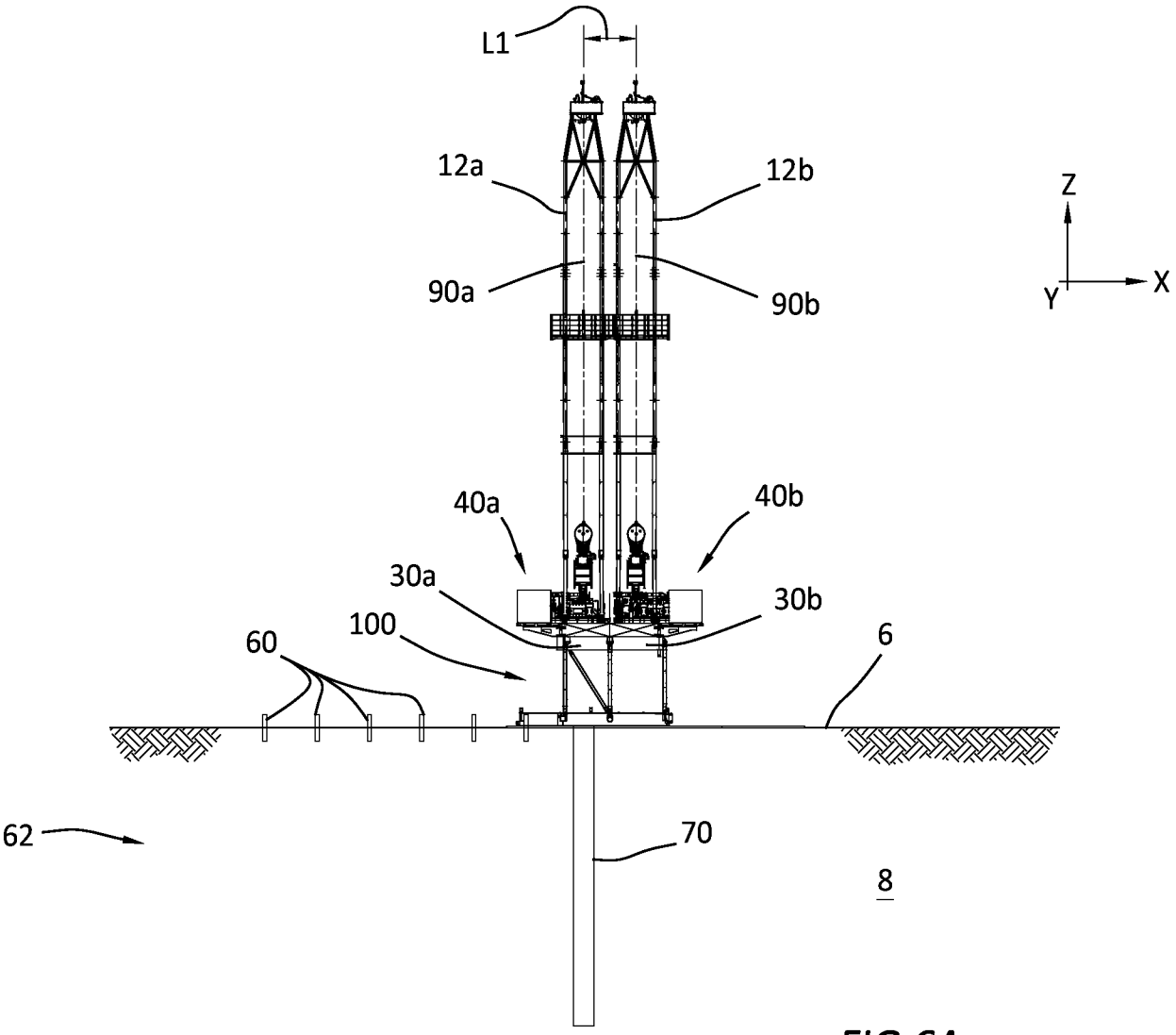
FIGS. 6A-6G are representative partial cross-sectional front views of a dual mast rig performing sequential operations on consecutive wellbores at one wellbore spacing in a row of wellbores, in accordance with certain embodiments.

FIG. 6A shows an array 62 of desired wellbore locations 60 before the wellbore array 62 is drilled in the earthen formation 8. The rig 10 has been moved to a first position in the array 62 such that the first well center 90*a* of the platform 30*a* is positioned over a first wellbore location 60. If adjustment of the well center 90*a* is needed after the rig 10 has been moved, then the drive system 50*a* can move the platform 30*a* as needed in the X-Y plane to align the well center 90*a* with the first wellbore location 60. When the well center 90*a* is properly aligned with the first wellbore location 60, the platform 30*a* can perform a subterranean operation on the first wellbore location 60, such as drilling a wellbore 70 in the earthen formation 8 in this example.

Figure 6B:
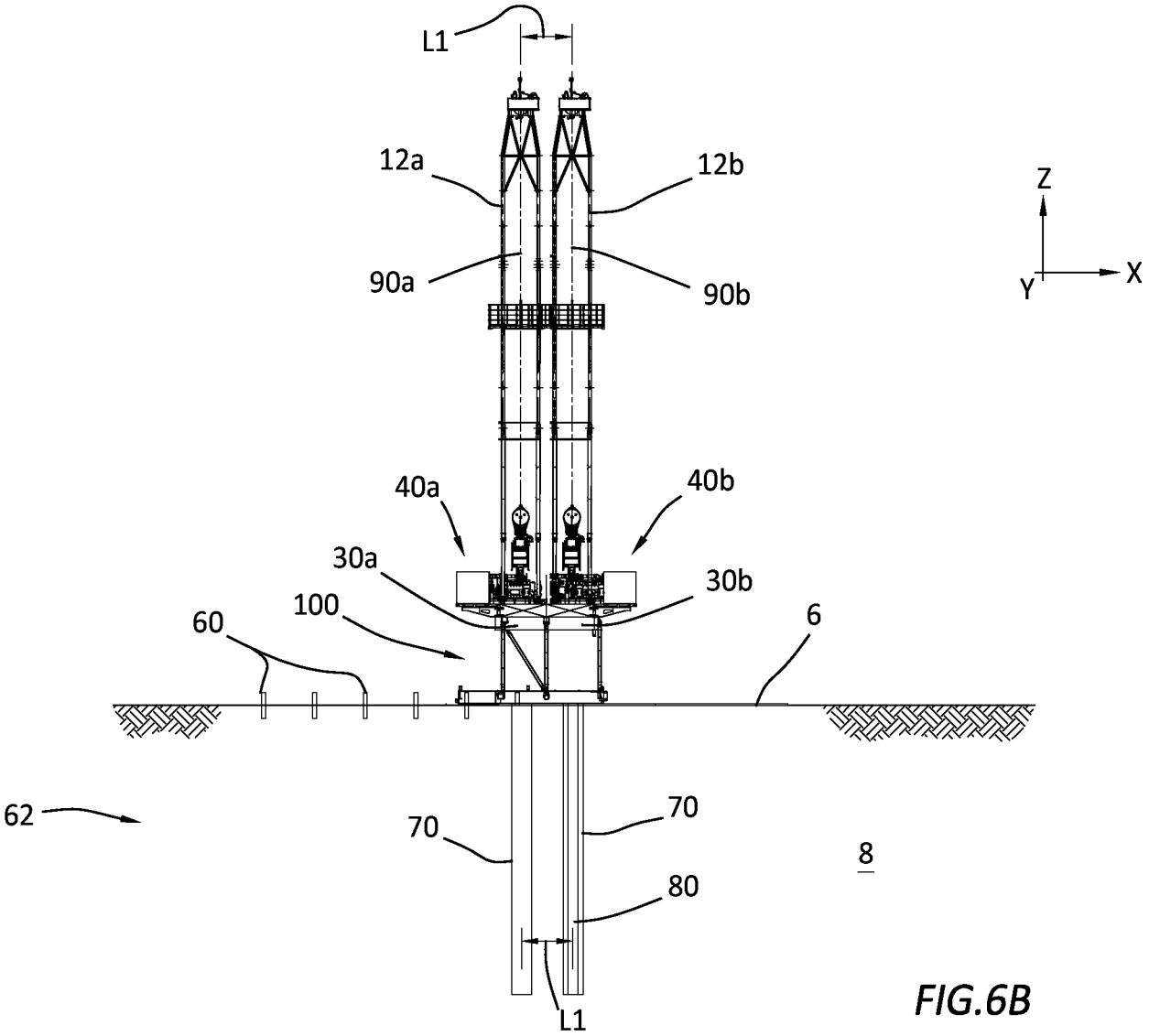

Referring now to FIG. 6B. When the first wellbore 70 is drilled to a desired depth at the first wellbore location, then the rig 10 can be moved to a second location where the well center 90*a* of the platform 30*a* is aligned with a second wellbore location 60 and the well center 90*b* platform 30*b* is aligned with the first wellbore location 60. The wellbore spacing L1 is minimized since the platforms 30*a*, 30*b* are abutting each other on the substructure 100. At the second location of the rig 10, the platform 30*a* can perform a subterranean operation on the second wellbore location 60, such as drilling a second wellbore 70 in this example, and the platform can perform another (and possibly a different type) subterranean operation on the first wellbore location 60, such as running casing 80 and cementing the casing 80 in the first wellbore 70.

Figure 6C:
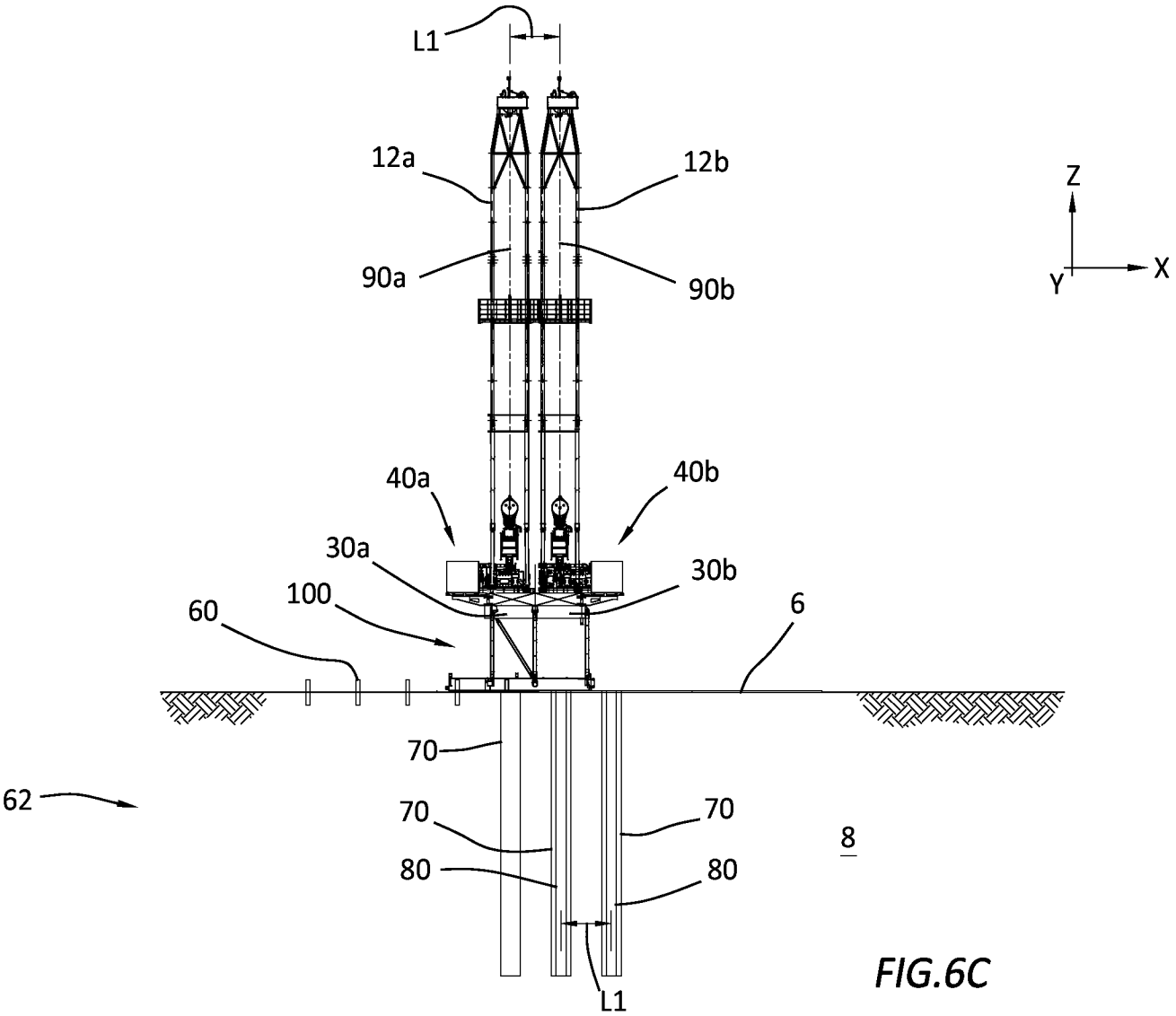

Referring now to FIG. 6C. When the second wellbore 70 is drilled to a desired depth and the casing 80 is installed in the first wellbore 70, then the rig 10 can be moved to a third location where the well center 90*a* of the platform 30*a* is aligned with a third wellbore location 60 and the well center 90*b* of platform 30*b* is aligned with the second wellbore location 60. At the third location of the rig 10, the platform 30*a* can perform a subterranean operation on the third wellbore location 60, such as drilling a third wellbore 70 in this example, and the platform 30*b* can perform another (and possibly a different type) subterranean operation on the second wellbore location 60, such as running casing 80 and cementing the casing 80 in the second wellbore 70.

This process of moving the rig 10 to a new location, aligning the well center 90*a* to the next wellbore location 60 and the well center 90*b* to the previous wellbore location 60, performing one subterranean operation on the next wellbore location 60 and performing another subterranean operation on the previous wellbore location 60 can continue until the rig 10 reaches the last wellbore location 60 in the array 62.

Figure 6D:
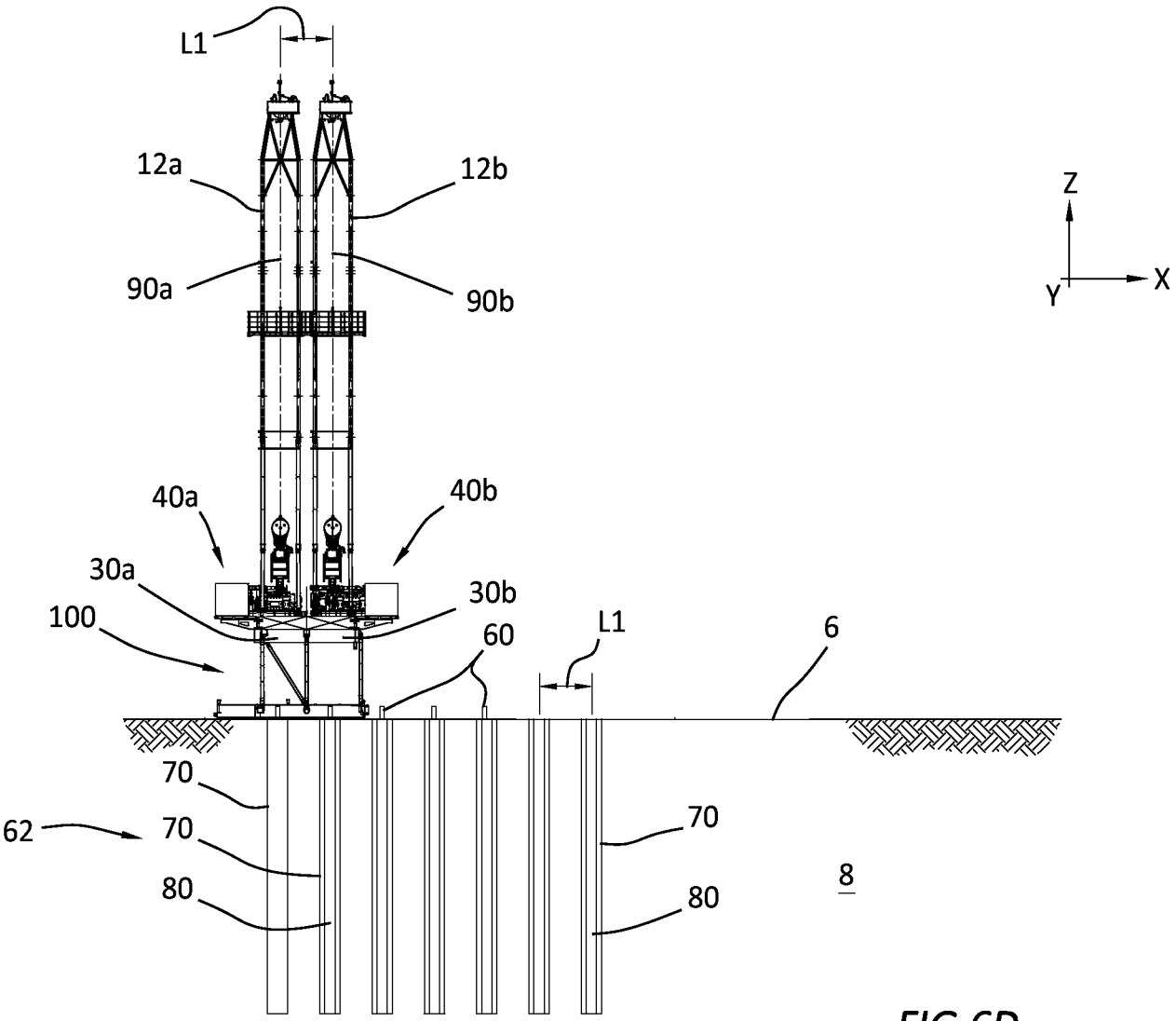

Referring now to FIG. 6D. The rig 10 can be positioned such that the well center 90*a* is aligned with the last wellbore location 60 in the array 62 and the well center 90*b* is aligned with the next to last wellbore location 60. The platform 30*a* can perform a subterranean operation on the last wellbore location 60, such as drilling a last wellbore 70 in this example, and the platform 30*b* can perform another (and possibly a different type) subterranean operation on the next to last wellbore location 60, such as running casing 80 and cementing the casing 80 in the second wellbore 70.

Figure 6E:
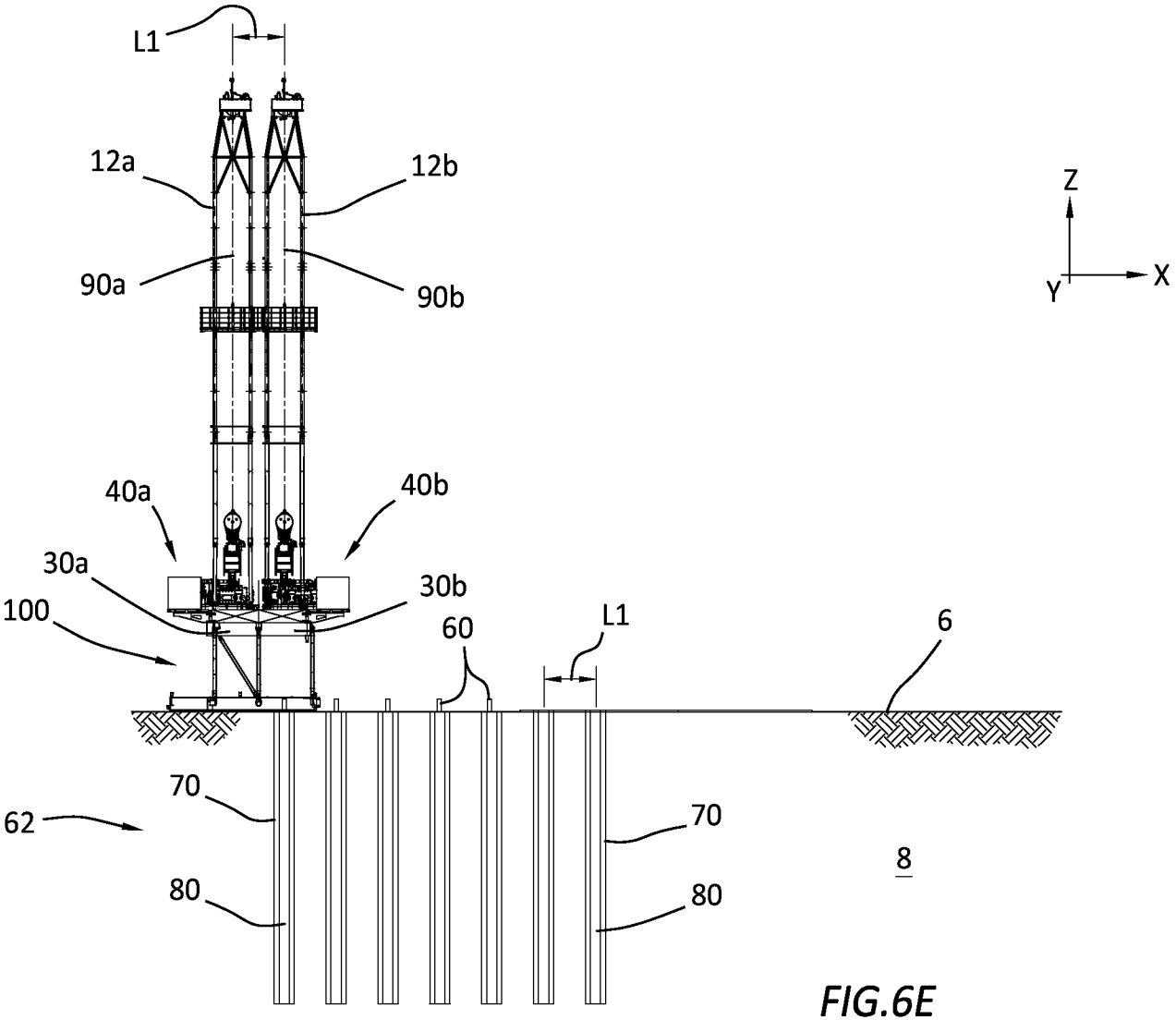

Referring now to FIG. 6E. The rig 10 can then be positioned such that the well center 90*a* is not aligned to a wellbore location 60 of the array 62, but the well center 90*b* is aligned with the last wellbore location 60. The platform 30*b* can perform a subterranean operation on the last wellbore location 60, such as running casing 80 and cementing the casing 80 in the second wellbore 70, thereby completing a first run through the wellbore locations 60 of the array 62.

Figure 6F:
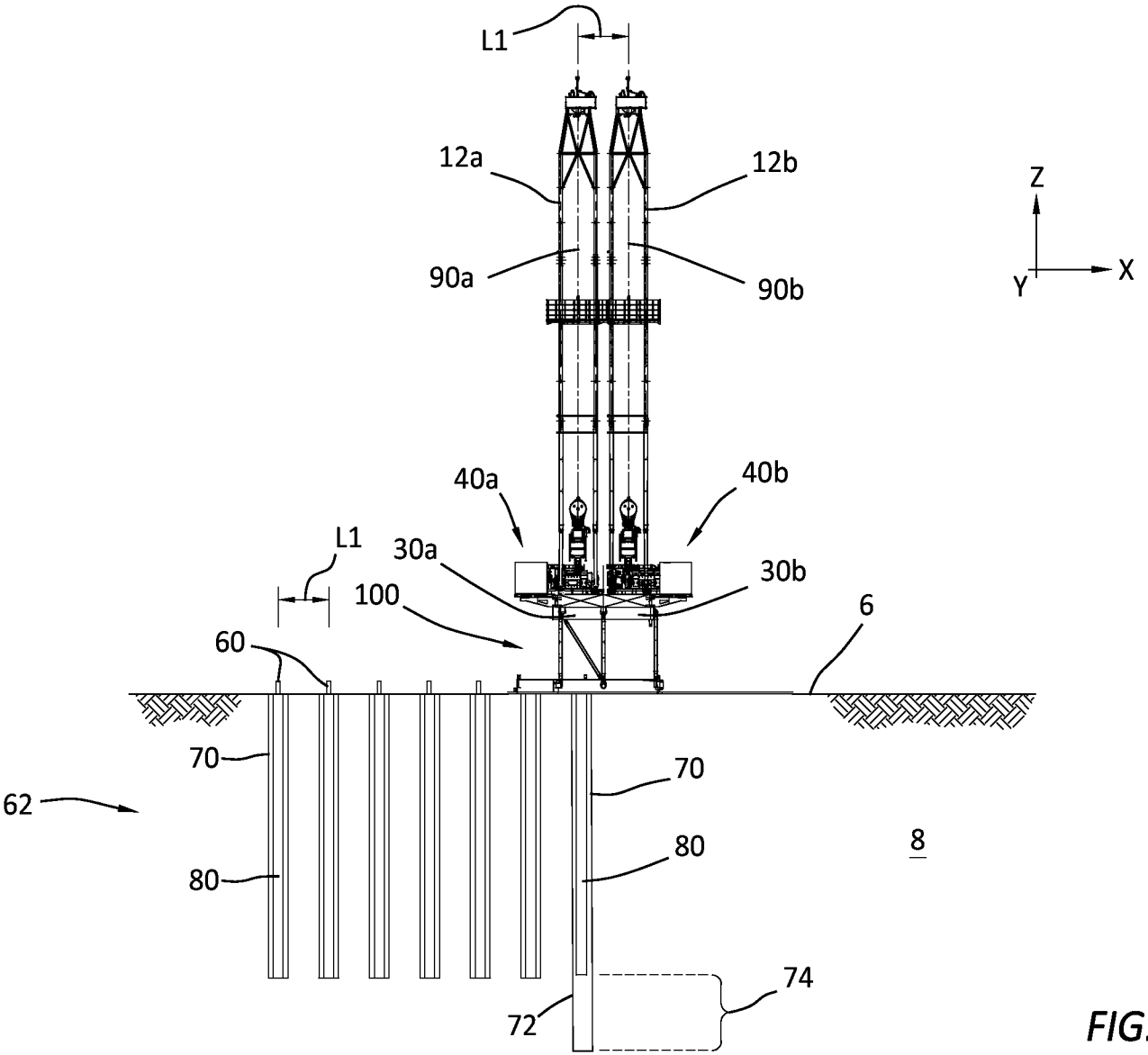

Referring now to FIG. 6F. If further subterranean operations are needed for the locations 60 in the array 62, then the rig 10 be returned to the first location with the well center 90*a* aligned with the first wellbore 70 and the well center 90*b* not aligned with a wellbore. The platform 30*a* can perform a subterranean operation on the first wellbore 70, such as drilling to extend the first wellbore 70 by a distance 74 in this example.

Figure 6G:
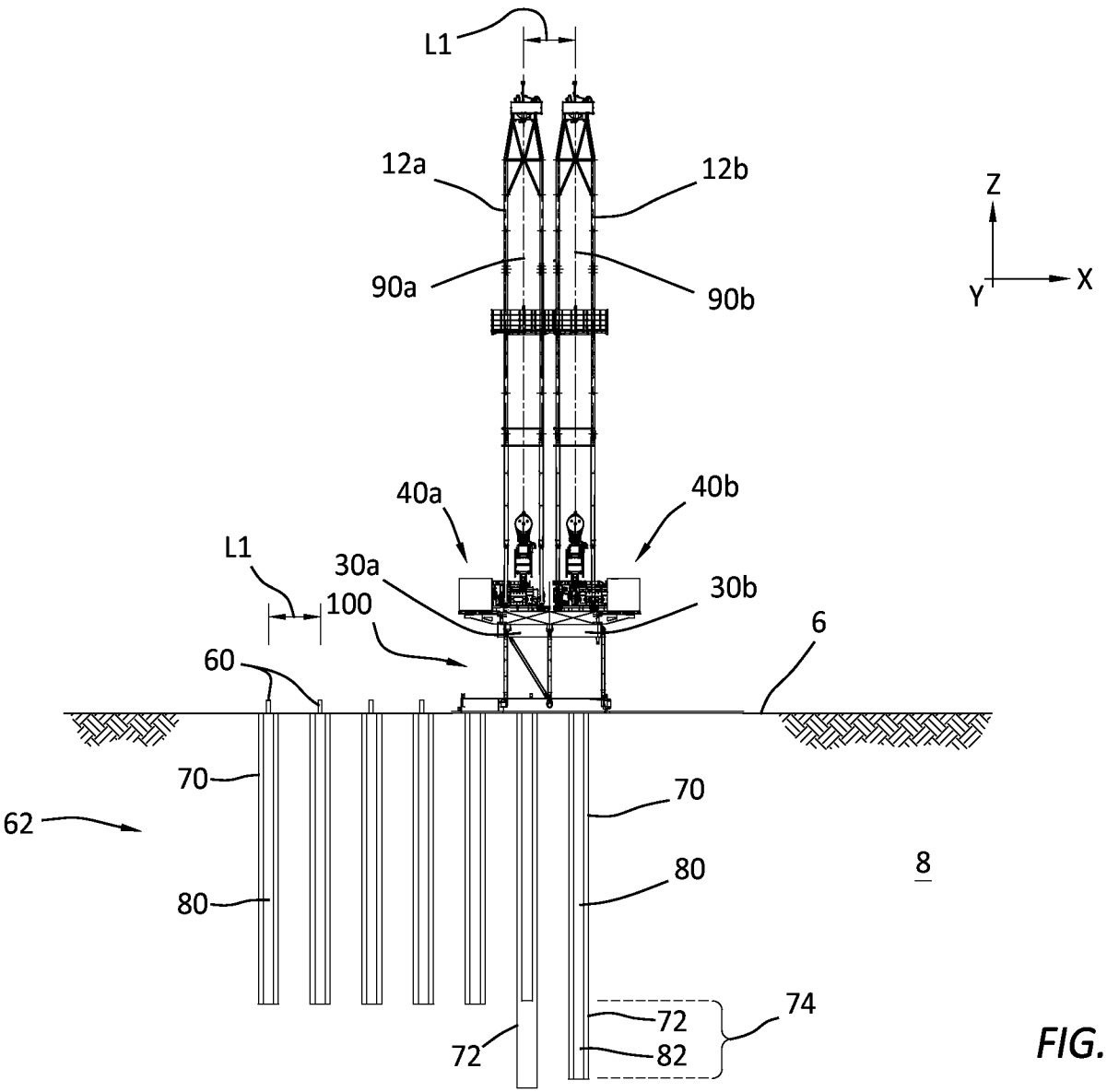

Referring now to FIG. 6G. The rig can then be moved to the second location with the well center 90*a* aligned with the second wellbore 70 and the well center 90*b* aligned with the first wellbore 70. The platform 30*a* can perform a subterranean operation on the second wellbore 70, such as drilling to extend the first wellbore 70 by a distance farther than the distance 74 in this example, with the extended wellbore portion 72 indicated. The platform 30*b* can perform another (and possibly a different type) subterranean operation on the first wellbore 70, such as running casing 82 to the extended wellbore portion 72 and cementing the casing 82 in the extended wellbore portion 72. This process can continue until all wellbore locations 60 have been worked as desired to produce the array 62 of wellbores 70. The rig 10 can be moved back to any position as many times as needed to complete the desired work.

It should be understood, that the rig 10 can move from right to left to work the wellbore array as shown in FIGS. 6A-6G, or the rig can move from right to left for the first pass through the wellbore array 62, and then reverse and move left to right through the wellbore array, and (if needed) reverse again and move right to left through the array 62, and so on. The rig 10 can also be moved to locations that are random and not in sequence.

It should also be understood that when aligning the well centers 90*a* or 90*b* are mentioned in this disclosure it is implied that these alignments can include X-Y movements of the platforms 30*a*, 30*b* relative to the substructure, as well as Z direction adjustments of the platforms 30*a*, 30*b* by tilting the platforms.

Referring now to FIGS. 7A-7F, which are representative partial cross-sectional front views of a dual mast rig 10 performing sequential operations on consecutive wellbore locations 60 in a wellbore array 62 at a second wellbore spacing L1 which is different than the wellbore spacing L1 in FIGS. 6A-6G.

Figure 7A:
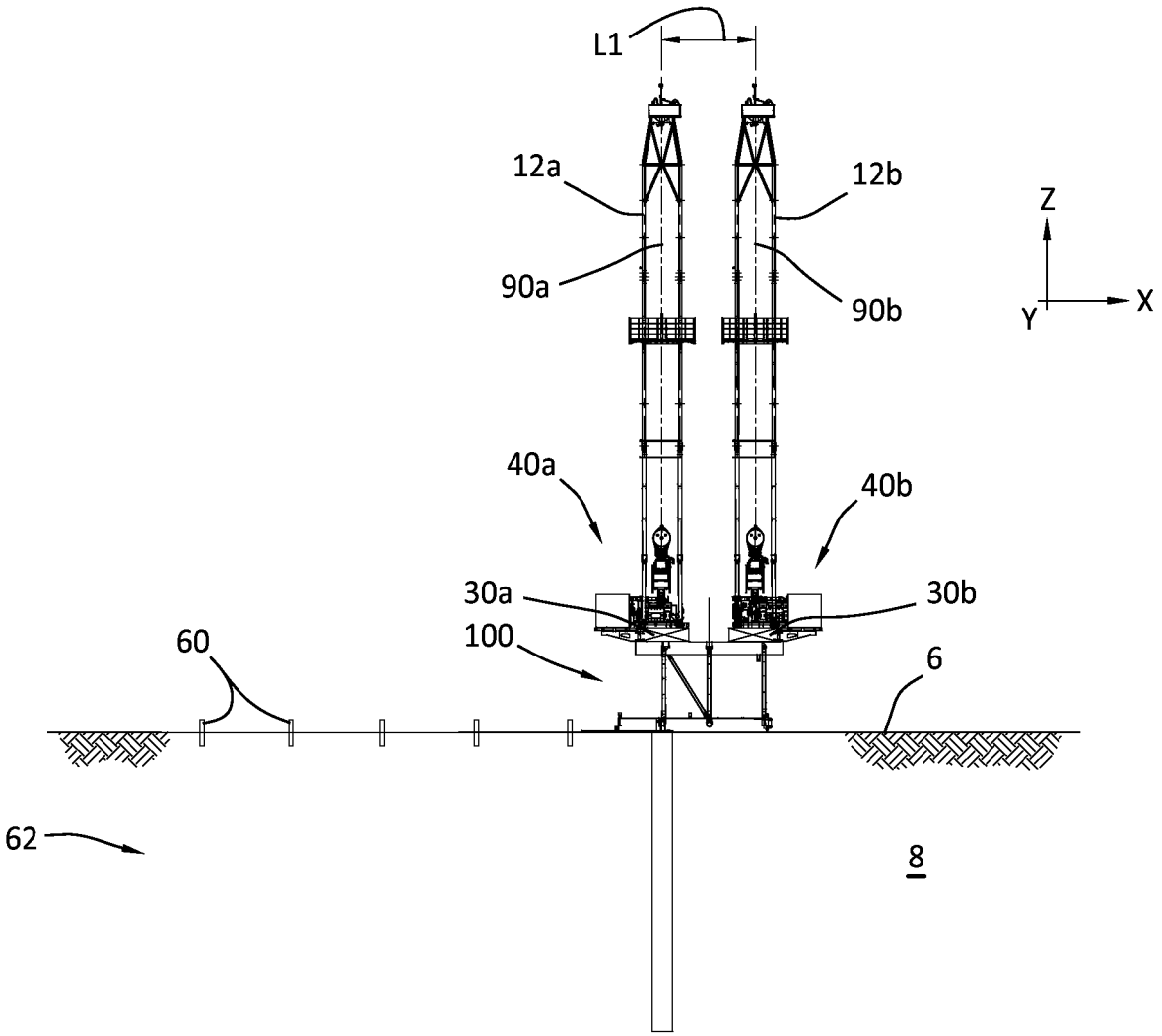
FIGS. 7A-7F are representative partial cross-sectional front views of a dual mast rig performing sequential operations on consecutive wellbores at another wellbore spacing in a row of wellbores, in accordance with certain embodiments.

FIG. 7A shows an array 62 of desired wellbore locations 60 before the wellbore array 62 is drilled in the earthen formation 8. The rig 10 has been moved to a first position in the array 62 such that the first well center 90*a* of the platform 30*a* is positioned over a first wellbore location 60. If adjustment of the well center 90*a* is needed after the rig 10 has been moved, then the drive system 50*a* can move the platform 30*a* as needed in the X-Y plane to align the well center 90*a* with the first wellbore location 60. When the well center 90*a* is properly aligned with the first wellbore location 60, the platform 30*a* can perform a subterranean operation on the first wellbore location 60, such as drilling a wellbore 70 in the earthen formation 8 in this example.

Figure 7B:
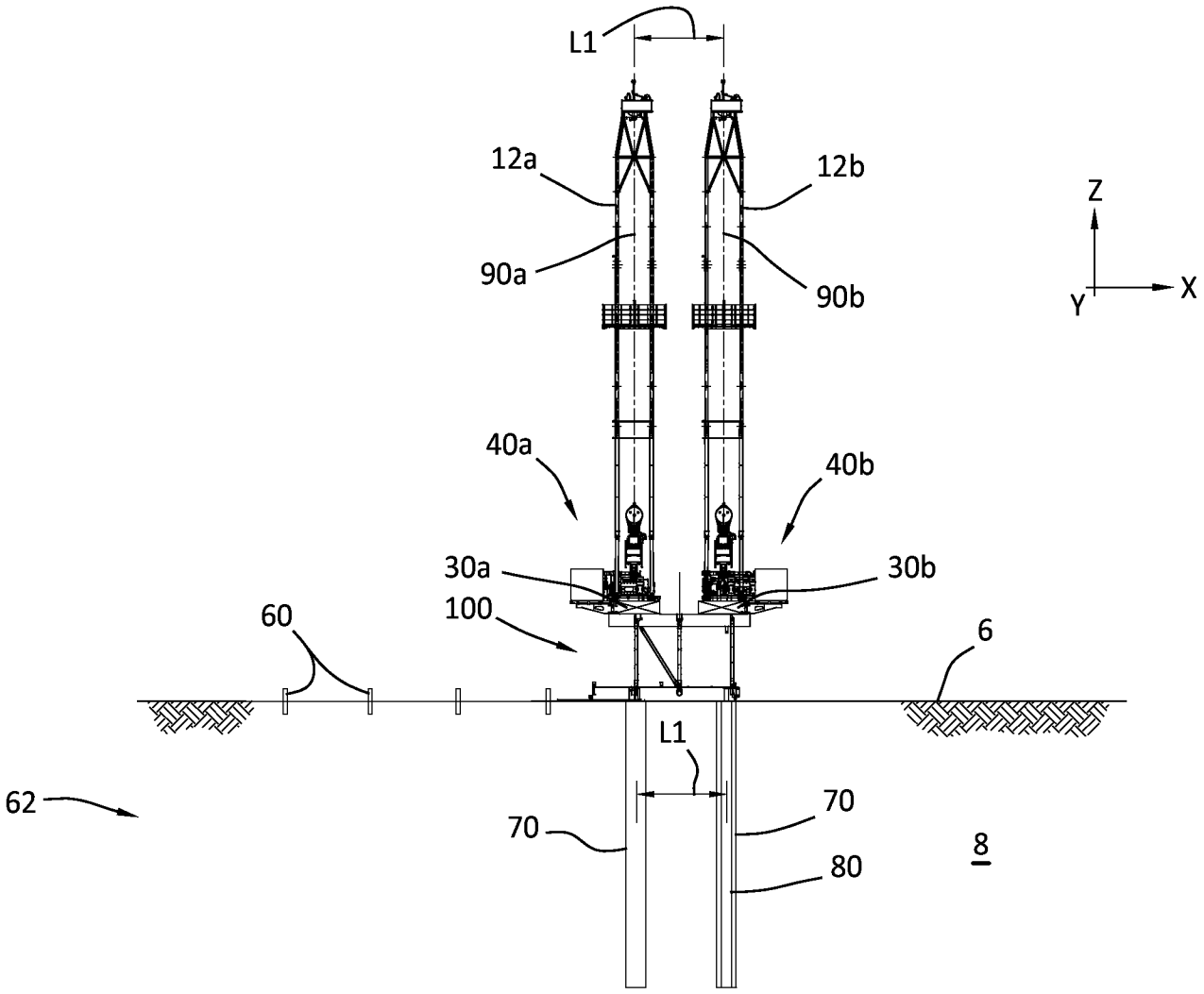

Referring now to FIG. 7B. When the first wellbore 70 is drilled to a desired depth at the first wellbore location, then the rig 10 can be moved to a second location where the well center 90*a* of the platform 30*a* is aligned with a second wellbore location 60 and the well center 90*b* platform 30*b* is aligned with the first wellbore location 60. The wellbore spacing L1 is set to a desired distance by moving the platforms 30*a*, 30*b* away from each other a desired distance L10 (see FIG. 4). At the second location of the rig 10, the platform 30*a* can perform a subterranean operation on the second wellbore location 60, such as drilling a second wellbore 70 in this example, and the platform 30*b* can perform another (and possibly a different type) subterranean operation on the first wellbore location 60, such as running casing 80 and cementing the casing 80 in the first wellbore 70.

Figure 7C:
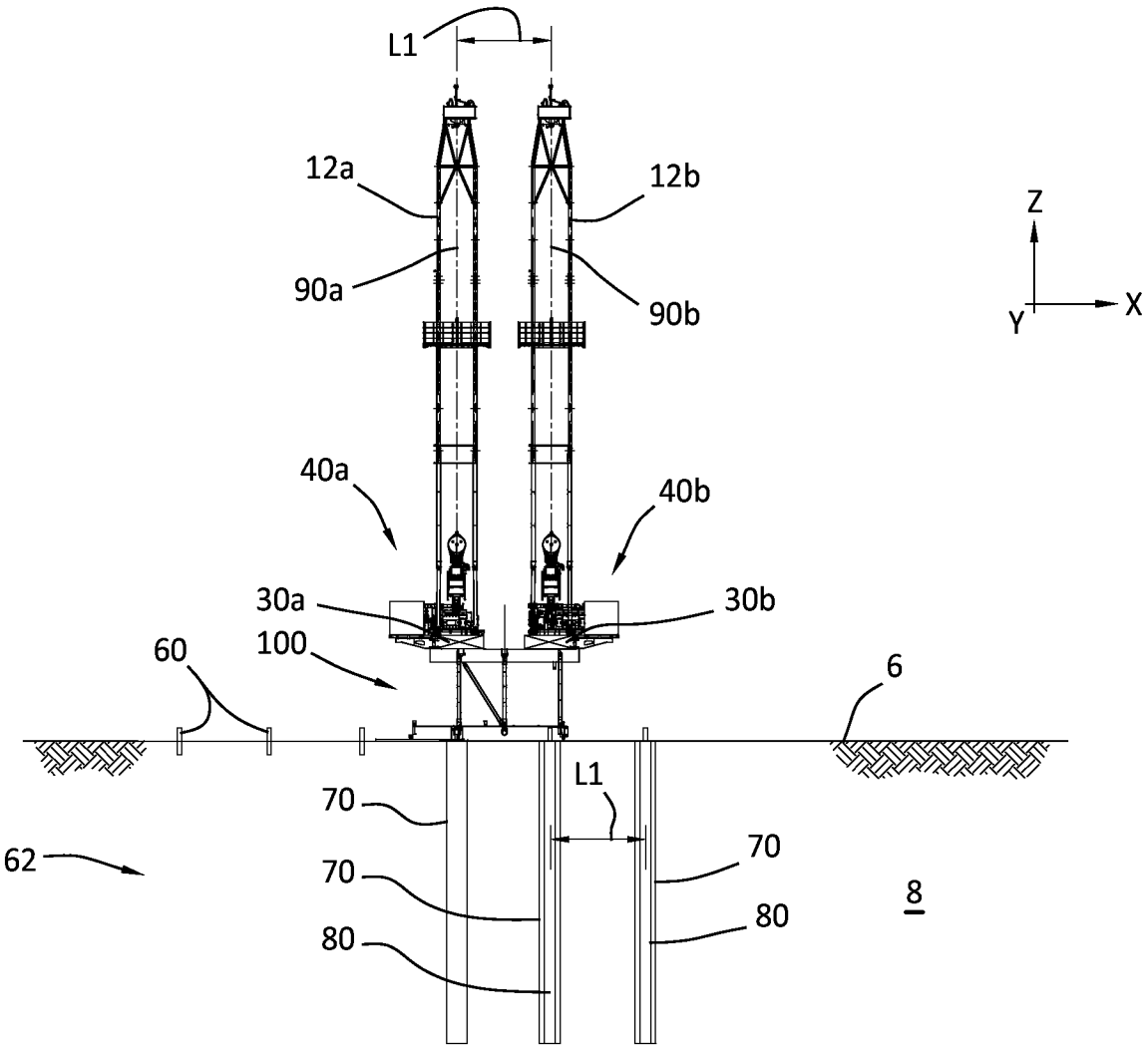

Referring now to FIG. 7C. When the second wellbore 70 is drilled to a desired depth and the casing 80 is installed in the first wellbore 70, then the rig 10 can be moved to a third location where the well center 90*a* of the platform 30*a* is aligned with a third wellbore location 60 and the well center 90*b* of platform 30*b* is aligned with the second wellbore location 60. At the third location of the rig 10, the platform 30*a* can perform a subterranean operation on the third wellbore location 60, such as drilling a third wellbore 70 in this example, and the platform 30*b* can perform another (and possibly a different type) subterranean operation on the second wellbore location 60, such as running casing 80 and cementing the casing 80 in the second wellbore 70.

This process of moving the rig 10 to a new location, aligning the well center 90*a* to the next wellbore location 60 and the well center 90*b* to the previous wellbore location 60, performing one subterranean operation on the next wellbore location 60 and performing another subterranean operation on the previous wellbore location 60 can continue until the rig 10 reaches the last wellbore location 60 in the array 62.

Figure 7D:
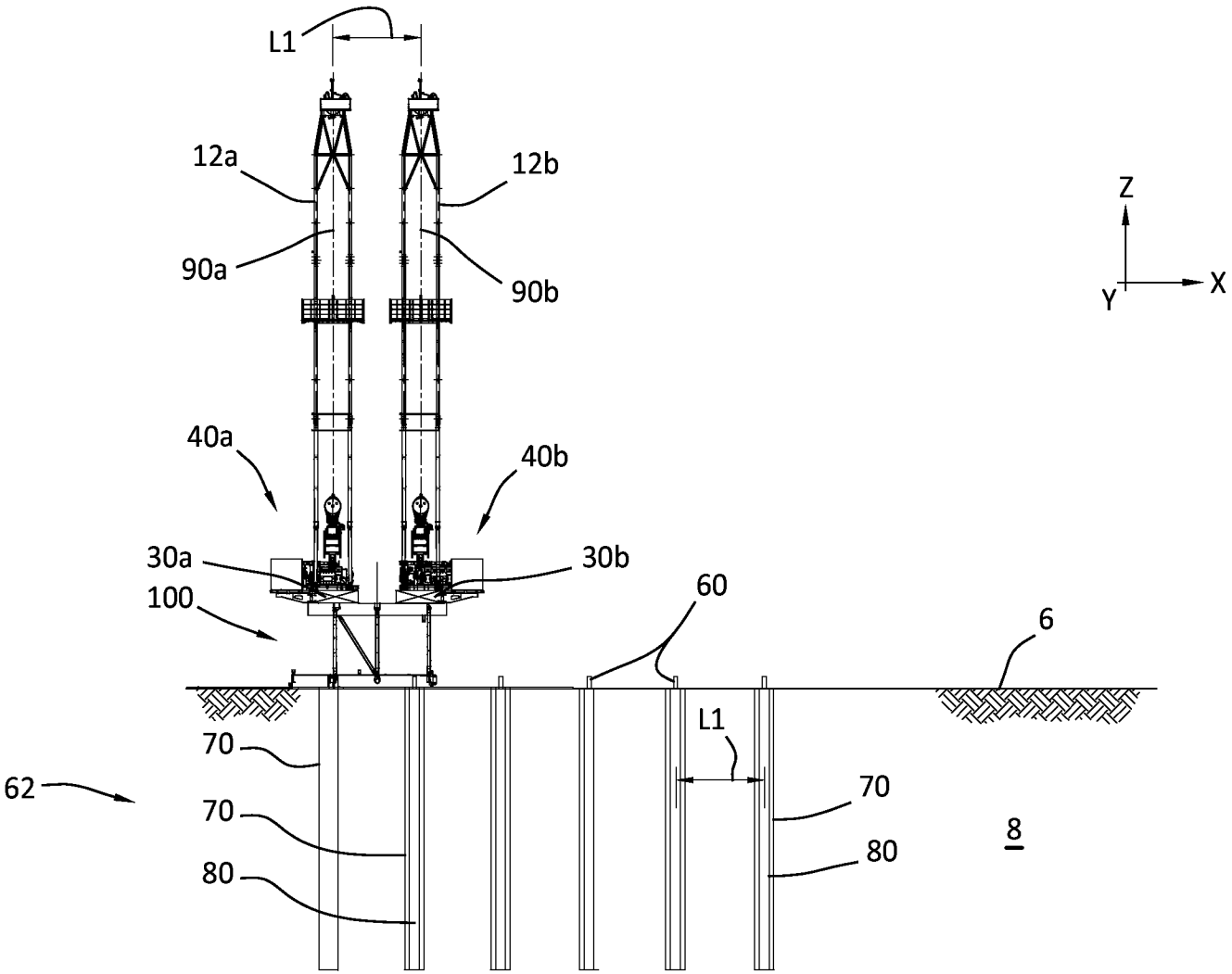

Referring now to FIG. 7D. The rig 10 can be positioned such that the well center 90*a* is aligned with the last wellbore location 60 in the array 62 and the well center 90*b* is aligned with the next to last wellbore location 60. The platform 30*a* can perform a subterranean operation on the last wellbore location 60, such as drilling a last wellbore 70 in this example, and the platform 30*b* can perform another (and possibly a different type) subterranean operation on the next to last wellbore location 60, such as running casing 80 and cementing the casing 80 in the second wellbore 70.

Figure 7E:
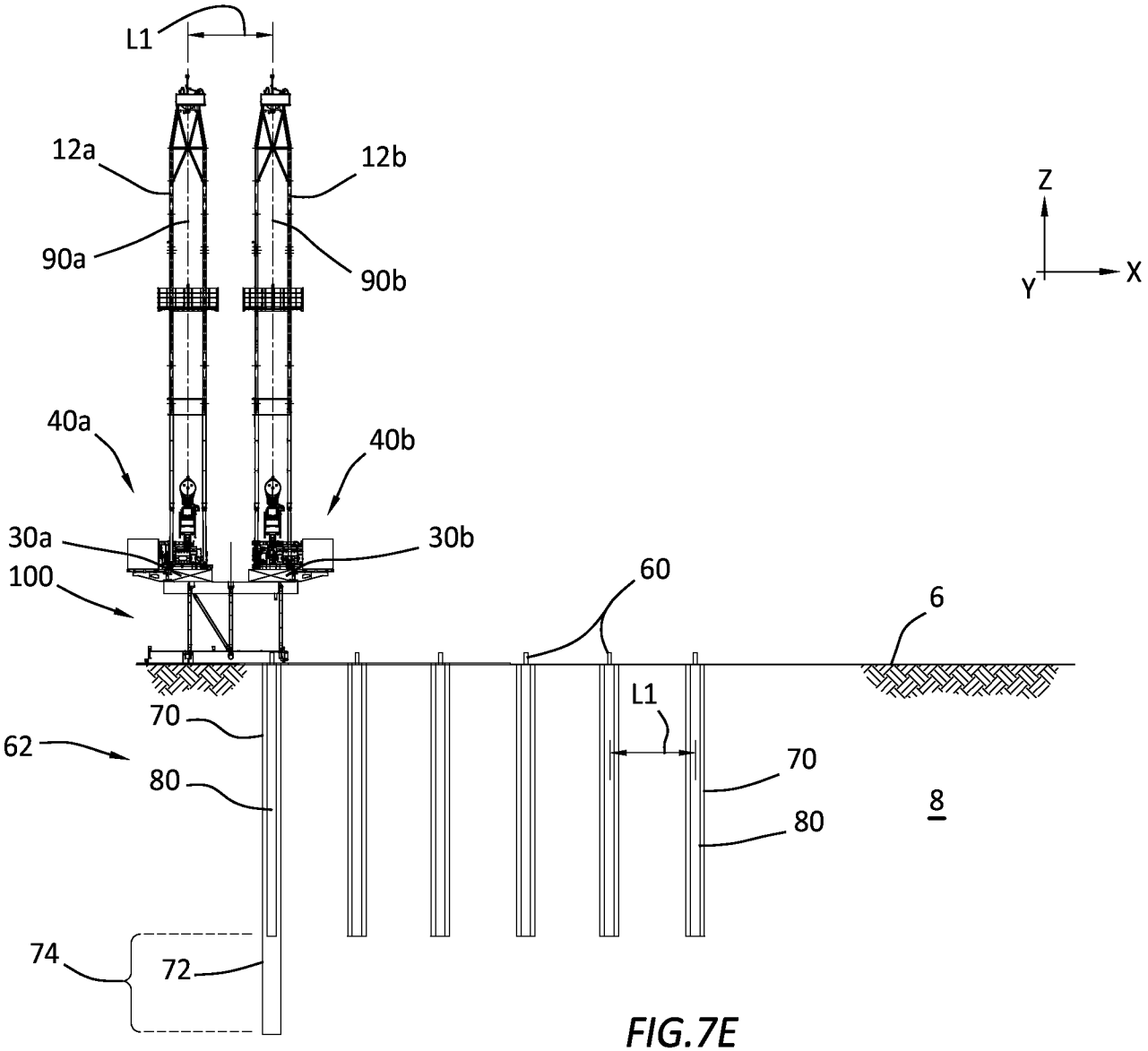

Referring now to FIG. 7E. The rig 10 can then be positioned such that the well center 90*a* is not aligned to a wellbore location 60 of the array 62, but the well center 90*b* is aligned with the last wellbore location 60. The platform 30*b* can perform a subterranean operation on the last wellbore location 60, such as running casing 80 and cementing the casing 80 in the second wellbore 70, thereby completing a first run through the wellbore locations 60 of the array 62.

If further subterranean operations are needed for the locations 60 in the array 62, then with the rig 10 still at the position with the well center 90*b* aligned with the last wellbore location 60, the platform 30*b* can perform a subterranean operation on the first wellbore 70, such as extending the wellbore 70 a distance indicated by 74 to include a new wellbore portion 72 in this example.

Figure 7F:
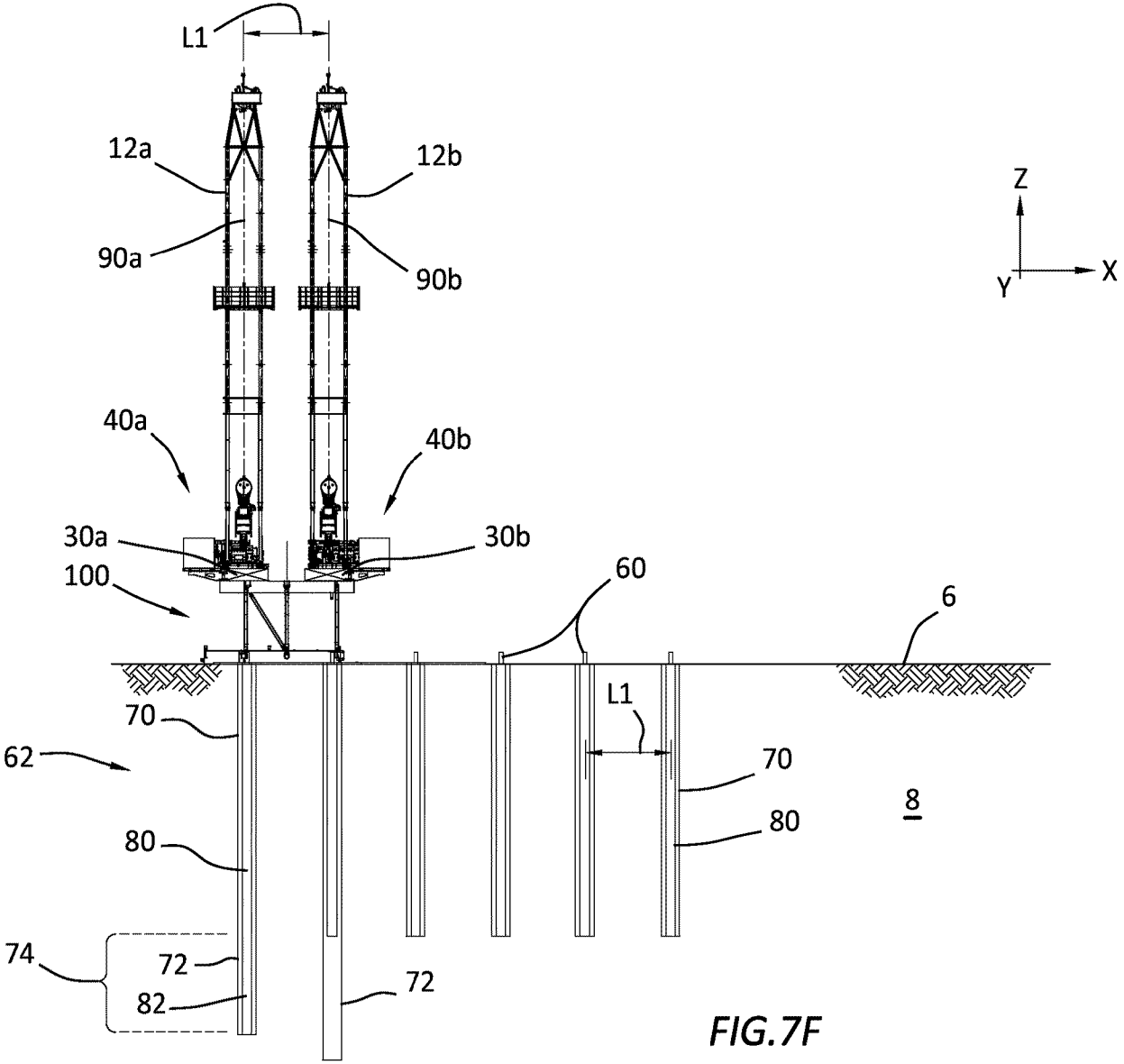

Referring now to FIG. 7F. The rig can be moved to the next to last location with the well center 90*a* aligned with the last wellbore 70 and the well center 90*b* aligned with the next to last wellbore 70. The platform 30*b* can perform a subterranean operation on the next to last wellbore 70, such as drilling to extend the first wellbore 70 by a distance farther than the distance 74 in this example, with the extended wellbore portion 72 indicated. The platform 30*a* can perform another (and possibly a different type) subterranean operation on the last wellbore 70, such as running casing 82 to the extended wellbore portion 72 and cementing the casing 82 in the extended wellbore portion 72. This process can continue until all wellbore locations 60 have been worked as desired to produce the array 62 of wellbores 70. The rig 10 can be moved back to any position as many times as needed to complete the desired work.

Therefore, it can be understood that this dual mast rig 10 is well suited for producing and working wellbores in wellbore arrays, with the wellbore arrays having various wellbore spacing L1.

Figure 8A:
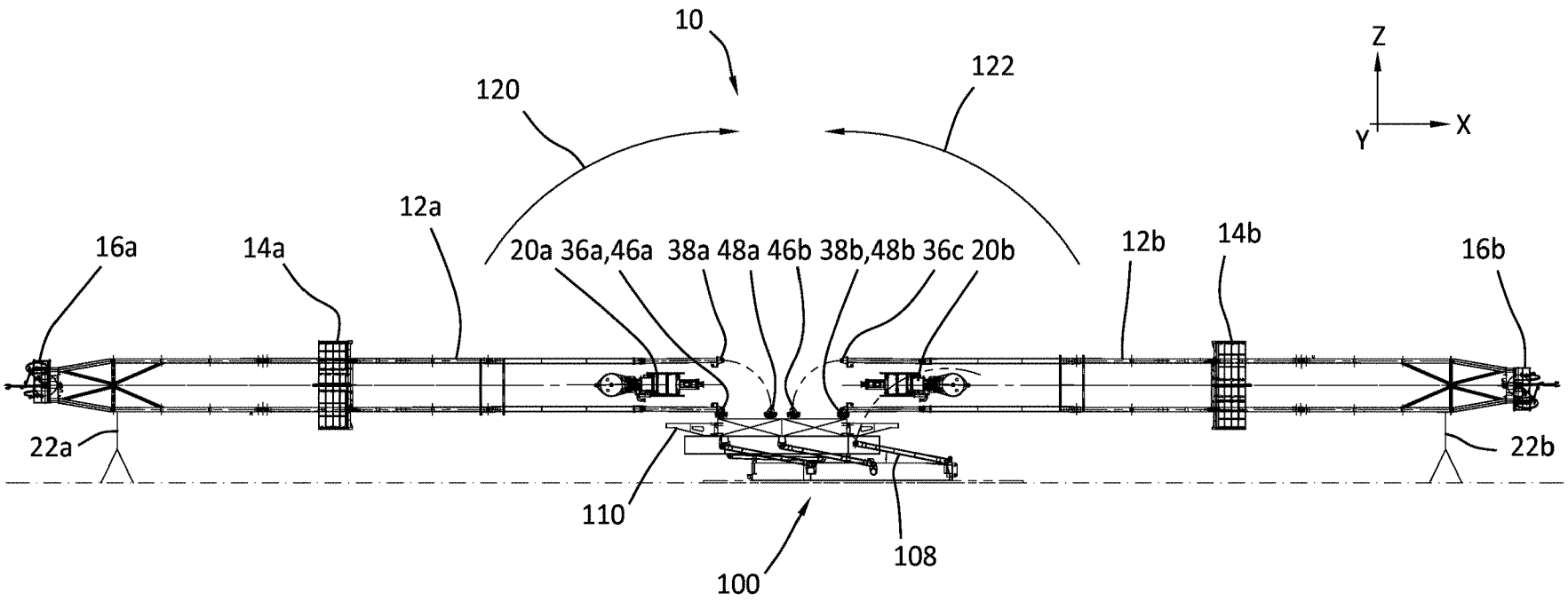
FIGS. 8A-8D are representative front views of sequential operations to raise and attach the two masts of a dual mast rig to the rig, in accordance with certain embodiments.

Referring now to FIGS. 8A-8D, which illustrate a method of assembling the dual mast rig 10. FIG. 8A shows the substructure 100 collapsed in a lowered position with the supports 106 rotated downward and the stabilizers 108 not yet installed. Connectors 36*a* of the left derrick 12*a* can be rotatably attached to the connectors 46*a* of the platform 30*a* with the derrick 12*a* being held in a horizontal position by the connectors 36*a*, 46*a* and the support 22*a*. Connectors 38*b* of the right derrick 12*b* can be rotatably attached to the connectors 48*b* of the platform 30*b* with the derrick 12*b* being held in a horizontal position by the connectors 38*b*, 48*b* and the support 22*b*.

Figure 8C:
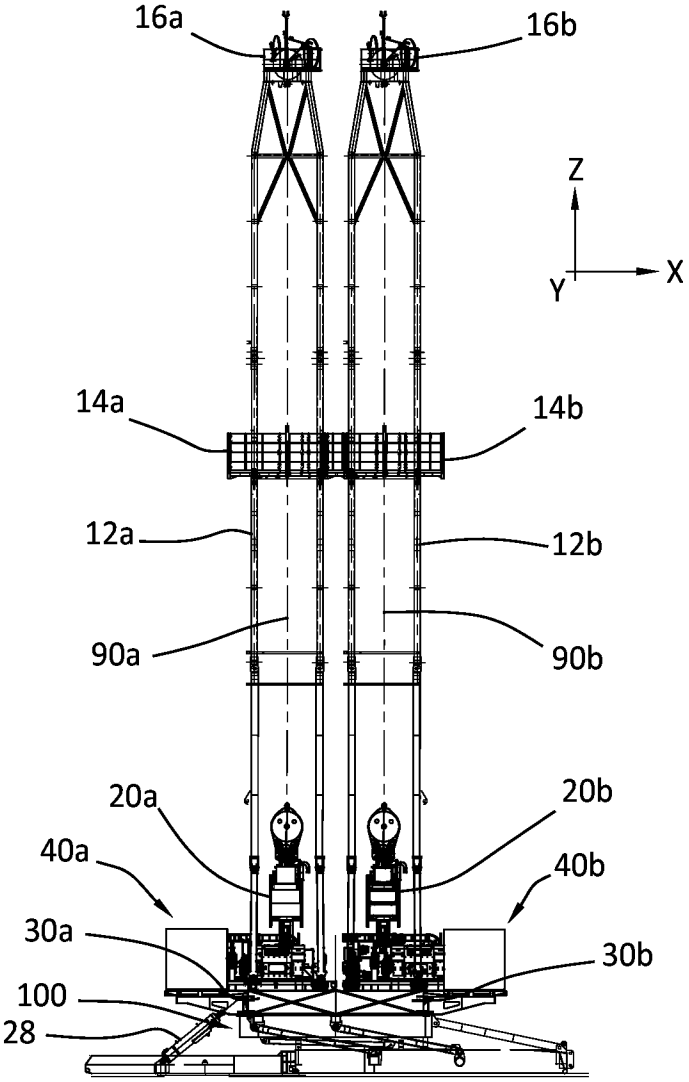
Figure 8B:
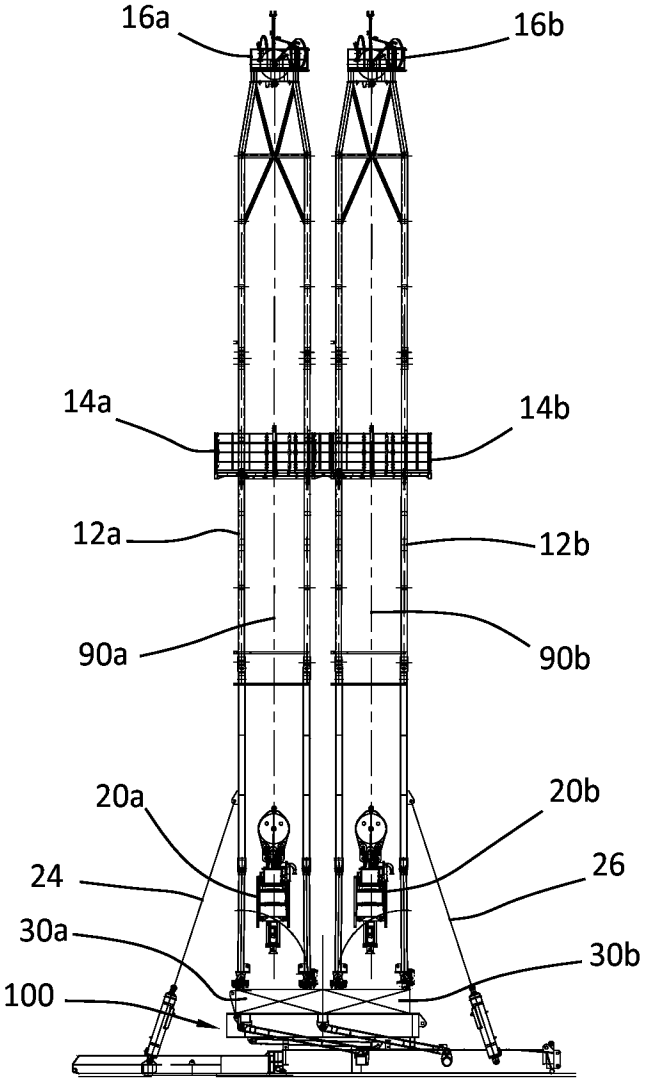

Referring now to FIGS. 8A and 8B. An actuator 24 can be attached between the bottom support structure 102 portion of the substructure 100 to lift the derrick 12*a* to a vertical position on the platform 30*a* by rotating the derrick 12*a* (arrow 120) where the derrick 12*a* can be secured in the vertical position by attaching connectors 38*a* of the derrick 12*a* to the connectors 48*a* of the platform 30*a*. It should be understood that other ways of lifting the derrick 12*a* to a vertical position that are known to those of ordinary skill in the art are also envisioned and are in keeping with the principles of this disclosure.

An actuator 26 can be attached between the bottom support structure 102 portion of the substructure 100 to lift the derrick 12*b* to a vertical position on the platform 30*b* by rotating the derrick 12*b* (arrow 122), where the derrick 12*b* can be secured in the vertical position by attaching connectors 36*b* of the derrick 12*b* to the connectors 46*b* of the platform 30*b*. It should be understood that other ways of lifting the derrick 12*b* to a vertical position that are known to those of ordinary skill in the art are also envisioned and are in keeping with the principles of this disclosure. FIG. 8B shows the derricks 12*a*, 12*b* mounted to the respective platforms 30*a*, 30*b* in a vertical operational position.

Referring now to FIG. 8C, support equipment 40*a*, 40*b* can be installed on the platforms 30*a*, 30*b* prior to rotating the substructure to a raised operational position. An actuator 28 can be attached between the bottom support structure 102 and the top support structure 110 of the substructure 100 to lift the top support structure 110 to the raised operational position.

Figure 8D:
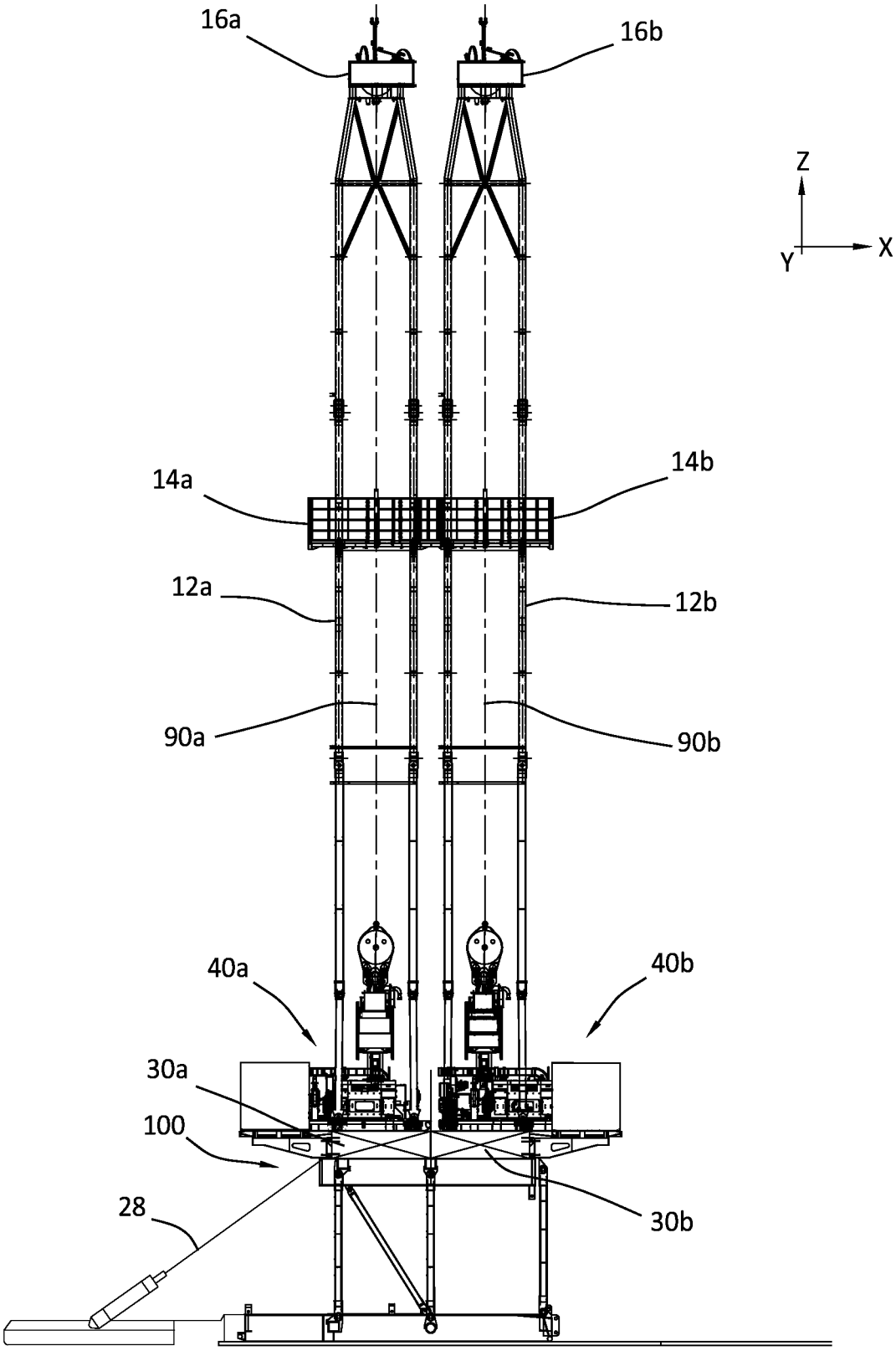

Referring now to FIG. 8D, the actuator 28 has rotated supports 106 upward to the raised operational position and the stabilizers 108 have been installed to secure the substructure in the raised operational position. The rig 10 is ready for operation, so the actuator 28 can be removed as well as an extension portion of the bottom support structure 102 of the substructure. Also, the transport system 104 can be assembled to the substructure 100 to facilitate movement of the rig 10.

Figure 9B:
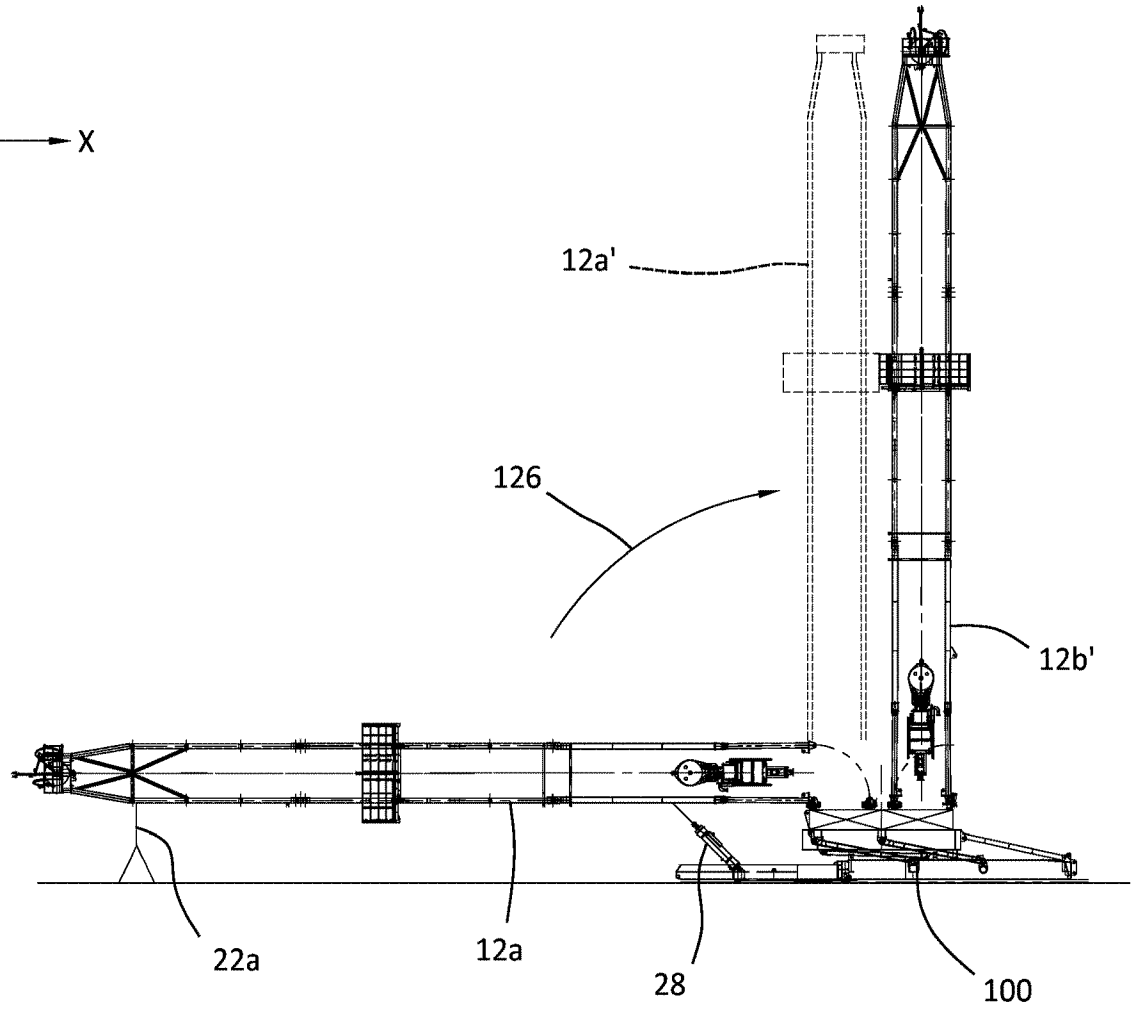
FIGS. 9A-9B are representative front views of other sequential operations to raise and attach the two masts of a dual mast rig to the rig, in accordance with certain embodiments.
Figure 9A:
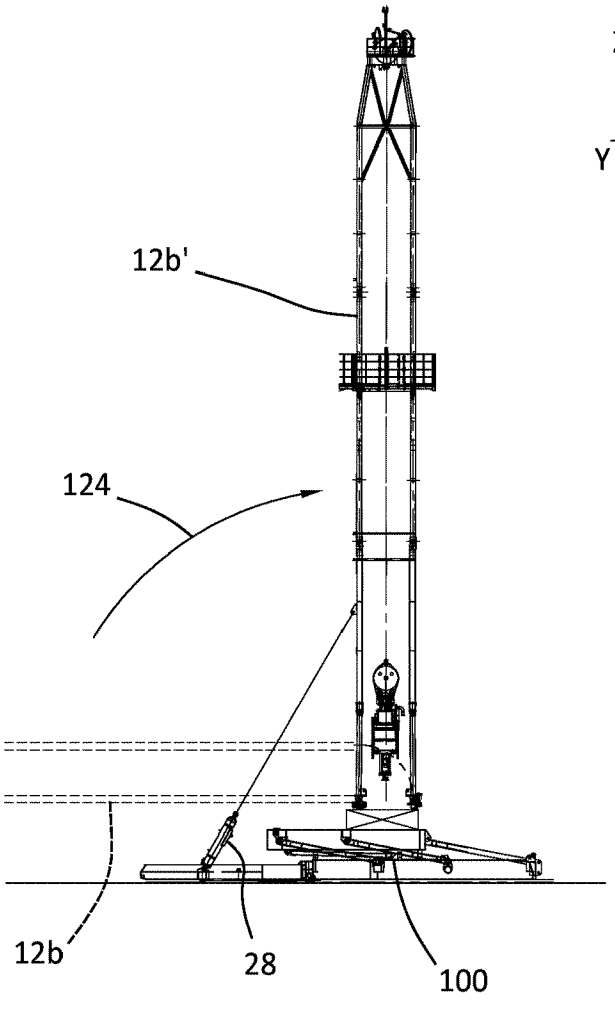

Referring to FIGS. 9A-9B, it should be understood that erecting the derricks 12*a*, 12*b* onto the platforms 30*a*, 30*b*, respectively, can be done other ways as well. For example, the derricks 12*a*, 12*b* can be rotated from horizontal to vertical positions from the back of the rig 10, from the front of the rig 10, from a single side, left or right (as opposed to both sides as in FIGS. 8A-8D) of the rig 10. FIGS. 9A-9B show erecting both derricks 12*a*, 12*b* from a left side of the rig 10. First (shown in FIG. 9A) the derrick 12*b* is rotationally connected to connectors on platform 30*b*, then the derrick 12*b* is rotated (arrow 124) into a vertical position (12*b*') on the platform 30*b* and secured by other platform connectors. Second (shown in FIG. 9B) the derrick 12*a* is rotationally connected to connectors on platform 30*a*, then the derrick 12*a* is rotated (arrow 126) into a vertical position (12*a*') on the platform 30*a* and secured by other platform connectors. Then the support equipment 40*a*, 40*b* can be installed on the platforms 30*a*, 30*b* and the substructure rotated and fixed in the raised operational position.

Figure 10:
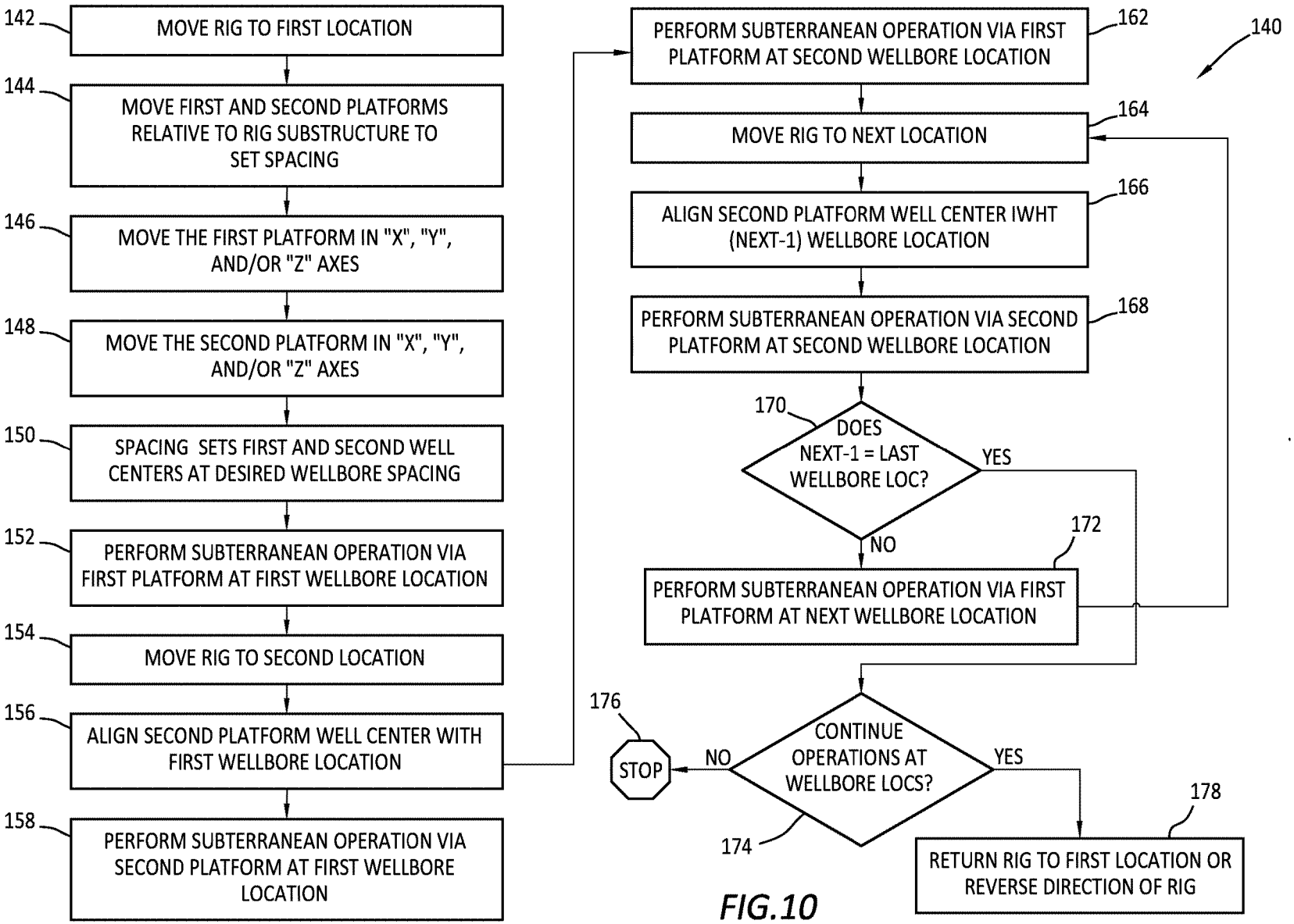
FIG. 10 is a representative flow diagram of a method for performing subterranean operations on multiple wellbores in a row of wellbores using a dual mast rig, in accordance with certain embodiments.

Referring to FIG. 10, which shows a representative flow diagram of a method for performing subterranean operations on multiple wellbores 70 in a row of wellbore locations 60 using a dual mast rig 10. The method 140 can include an operation 142 for moving the rig 10 to a first location in a wellbore array 62 of wellbore locations 60. In operation 144, the platforms 30*a*, 30*b* can be moved independently from each other and the substructure 100 to set a wellbore spacing L1 as well as align the well centers 90*a*, 90*b* to a pair of wellbore locations. In operations 146 and 148, the platforms 30*a*, 30*b* can be moved in the X or Y directions to align the platforms 30*a*, 30*b* to respective ones of the wellbore locations 60 in the wellbore array 62. The derricks 12*a*, 12*b* can also be adjusted (via shims, actuators, etc.) to align a center of each of the derricks 12*a*, 12*b* with a respective Z axis that is perpendicular to the respective drill floor 32*a*, 32*b* or parallel to a center of an existing wellbore 70. In operation 150, the wellbore spacing can be set to a desired wellbore spacing L1. In operation 152, perform a subterranean operation at a first wellbore position 60 via the platform 30*a*. In operation 154, move the rig 10 to a second location. In operation 156, align the well center 90*b* of the platform 30*b* with the first wellbore location 60. In operation 158, perform a subterranean operation at the first wellbore position 60 via the platform 30*b*.

In operation 162, perform a subterranean operation at a second wellbore position 60 via the platform 30*a*. In operation 164, move the rig 10 to a next location. In operation 166, align the well center 90*b* of the platform 30*b* with the previous (next-1) wellbore location 60, where the previous wellbore location is the location that was previously aligned with the well center 90*a* before the rig moved to the next location. In operation 168, perform a subterranean operation at the previous (next-1) wellbore position 60 via the platform 30*b*. In operation 170, determine if the previous (next-1) wellbore location is the last wellbore location of the wellbore row of the array 62. If it is, then determine in operation 174 if operations should continue or not. If the previous (next-1) wellbore location is not the last wellbore location of the wellbore row of the array 62, then proceed to operation 172 to perform a subterranean operation at the next wellbore position 60 via the platform 30*a*, and then repeat operations 164, 166, 168, 170. If in operation 174, wellbore operations should not continue, then in operation 178 stop the wellbore operations. If in operation 174, wellbore operations should continue, then move the rig 10 to the first location or move the rig in a reverse direction from the next wellbore location to the next-1 wellbore location and proceed with sequencing back through the wellbore array 62 working the wellbores 70 in the array 62.

EMBODIMENTS

Embodiment 1

A system for performing a subterranean operation, the system comprising:

a substructure of a rig configured to move from a first position to a second position;

a first platform overlying and coupled to the substructure; and a second platform overlying and coupled to the substructure, the second platform being different than the first platform, wherein the first platform is configured to move independently from and relative to the substructure.

Embodiment 2

The system of embodiment 1, wherein the first platform is configured to move independently from and relative to the second platform.

Embodiment 3

The system of embodiment 2, wherein the second platform is configured to move independently from and relative to the substructure.

Embodiment 4

The system of embodiment 3, wherein the second platform is configured to move independently from and relative to the first platform.

Embodiment 5

The system of embodiment 4, wherein movement of the substructure from the first position to the second position includes movement of the first platform and second platform together.

Embodiment 6

The system of embodiment 4, wherein the first platform is configured to move in an X direction or a Y direction, wherein the X direction is defined by a width of the first platform and the Y direction is defined by a length of the first platform, and wherein the length of the first platform and the width of the first platform define a first rig floor plane.

Embodiment 7

The system of embodiment 6, wherein the first platform is configured to move relative to the substructure in the X direction for a distance of at least 0.5% of the width of the first platform, or at least 1%, or 2%, or 3%, or 4%, or 5%, or 8%, or 10%, or 12%, or 14%, or 16%, or 18%, or 20%, or 25%, or 30%, or 35%, or 40%, or 45%, or 50%, or 55%, or 60%, or 65%, or 70%, or 75%, or 80%, or 85%, or 90%, or 95%, or 100% of the width of the first platform.

Embodiment 8

The system of embodiment 7, wherein the first platform is configured to move relative to the substructure in the X direction for a distance of less than 200% of the width of the first platform, or less than 180%, or 150%, or 120%, or 100%, or 90%, or 80%, or 70%, or 60%, or 50%, or 40%, or 30%, or 20%, or 10% of the width of the first platform.

Embodiment 9

The system of embodiment 7, wherein the first platform is configured to move relative to the substructure in the X direction for a distance of at least 0.01 m, or 0.1 m, or 0.5 m, or 1 m, or 1.5 m, or 2 m, or 2.5 m, or 3 m, or 3.5 m, or 4 m, or 4.5 m.

Embodiment 10

The system of embodiment 6, wherein the first platform is configured to move relative to the substructure in the Y direction for a distance of at least 0.1% of the length of the first platform, or at least 0.2%, or 0.3%, or 0.4%, or 0.5%, or 0.6%, or 0.7%, or 0.8%, or 0.9%, or 1%, or 1.5%, or 2%, or 2.5%, or 3%, or 3.5%, or 4%, or 5%, or 6%, or 7%, or 8%, or 9%, or 10% of the length of the first platform.

Embodiment 11

The system of embodiment 10, wherein the first platform is configured to move relative to the substructure in the Y direction for a distance of less than 40% of the length of the first platform, or less than 38%, or 35%, or 32%, or 30%, or 27%, or 25%, or 22%, or 20%, or 18%, or 15%, or 12%, or 10%, or 9%, or 8%, or 7%, or 6%, or 5%, or 4%, or 3%, or 2%, or 1% of the length of the first platform.

Embodiment 12

The system of embodiment 10, wherein the first platform is configured to move relative to the substructure in the Y direction for a distance of at least 0.01 m, or 0.1 m, or 0.2 m, or 0.3 m, or 0.4 m, or 0.5 m, or 0.6 m, or 0.7 m, or 0.8 m, or 0.9 m, or 1 m, or 1.2 m, or 1.5 m, or 1.8 m, or 2 m, or 2.2 m, or 2.4 m, or 2.6 m, or 2.8 m, or 3 m.

Embodiment 13

The system of embodiment 4, wherein the second platform is configured to move in an X direction or a Y direction, wherein the X direction is defined by a width of the second platform and the Y direction is defined by a length of the second platform, and wherein the length and the width of the second platform define a second rig floor plane.

Embodiment 14

The system of embodiment 13, wherein the second platform is configured to move relative to the substructure in the X direction for a distance of at least 0.5% of the width of the second platform, or at least 1%, or 2%, or 3%, or 4%, or 5%, or 8%, or 10%, or 12%, or 14%, or 16%, or 18%, or 20%, or 25%, or 30%, or 5%, or 40%, or 45%, or 50%, or 55%, or 60%, or 65%, or 70%, or 75%, or 80%, or 85%, or 90%, or 95%, or 100% of the width of the second platform.

Embodiment 15

The system of embodiment 14, wherein the second platform is configured to move relative to the substructure in the X direction for a distance of less than 200% of the width of the second platform, or less than 180%, or 150%, or 120%, or 100%, or 90%, or 80%, or 70%, or 60%, or 50%, or 40%, or 30%, or 20%, or 10% of the width of the second platform.

Embodiment 16

The system of embodiment 14, wherein the second platform is configured to move relative to the substructure in the X direction for a distance of at least 0.01 m, or 0.1 m, or 0.5 m, or 1 m, or 1.5 m, or 2 m, or 2.5 m, or 3 m, or 3.5 m, or 4 m, or 4.5 m.

Embodiment 17

The system of embodiment 13, wherein the second platform is configured to move relative to the substructure in the Y direction for a distance of at least 0.1% of the length of the second platform, or at least 0.2%, or 0.3%, or 0.4%, or 0.5%, or 0.6%, or 0.7%, or 0.8%, or 0.9%, or 1%, or 1.5%, or 2%, or 2.5%, or 3%, or 3.5%, or 4%, or 5%, or 6%, or 7%, or 8%, or 9%, or 10% of the length of the second platform.

Embodiment 18

The system of embodiment 17, wherein the second platform is configured to move relative to the substructure in the Y direction for a distance of less than 40% of the length of the first platform, or less than 38%, or 35%, or 32%, or 30%, or 27%, or 25%, or 22%, or 20%, or 18%, or 15%, or 12%, or 10%, or 9%, or 8%, or 7%, or 6%, or 5%, or 4%, or 3%, or 2%, or 1% of the length of the second platform.

Embodiment 19

The system of embodiment 17, wherein the second platform is configured to move relative to the substructure in the Y direction for a distance of at least 0.01 m, or 0.1 m, or 0.2 m, or 0.3 m, or 0.4 m, or 0.5 m, or 0.6 m, or 0.7 m, or 0.8 m, or 0.9 m, or 1 m, or 1.2 m, or 1.5 m, or 1.8 m, or 2 m, or 2.2 m, or 2.4 m, or 2.6 m, or 2.8 m, or 3 m.

Embodiment 20

The system of embodiment 1, further comprising a first drive system coupled between the substructure and the first platform, wherein the first drive system is configured to move the first platform from a first position to a second position.

Embodiment 21

The system of embodiment 20, further comprising a second drive system coupled between the substructure and the second platform with the second drive system being different that the first drive system, wherein the second drive system is configured to move the second platform from a first position to a second position.

Embodiment 22

The system of embodiment 21, wherein the first drive system and the second drive system are configured to actuate separately from each other.

Embodiment 23

The system of embodiment 21, wherein the first drive system comprises actuators that are electrical, electro-mechanical, magnetic, electromagnetic, hydraulic, pneumatic, or combinations thereof.

Embodiment 24

The system of embodiment 23, wherein the first drive system comprises hydraulic actuators coupled between the first platform and the substructure to move the first platform relative to the substructure.

Embodiment 25

The system of embodiment 23, wherein the first drive system comprises a cable and pulley system with motors driving the cables through a pulley system to move the first platform relative to the substructure.

Embodiment 26

The system of embodiment 23, wherein the first drive system comprises a screw-type drive system coupled between the first platform and the substructure to move the first platform relative to the substructure.

Embodiment 27

The system of embodiment 23, wherein the first drive system comprises a rack and pinion moving system.

Embodiment 28

The system of embodiment 21, wherein the second drive system comprises actuators that are electrical, electro-mechanical, magnetic, electromagnetic, hydraulic, pneumatic, or combinations thereof.

Embodiment 29

The system of embodiment 28, wherein the second drive system comprises hydraulic actuators coupled between the second platform and the substructure to move the second platform relative to the substructure.

Embodiment 30

The system of embodiment 28, wherein the second drive system comprises a cable and pulley system with motors driving the cables through a pulley system to move the second platform relative to the substructure.

Embodiment 31

The system of embodiment 28, wherein the second drive system comprises a screw-type drive system coupled between the second platform and the substructure to move the second platform relative to the substructure.

Embodiment 32

The system of embodiment 28, wherein the first drive system comprises a rack and pinion moving system.

Embodiment 33

The system of embodiment 1, wherein the first platform comprises a first well center and the second platform comprises a second well center, and wherein a distance between the first and second well centers is adjustable by one of:

movement of the first platform relative to the substructure, movement of the second platform relative to the substructure, and movement of both the first and second platforms relative to the substructure.

Embodiment 34

The system of embodiment 1, wherein the first platform is configured to move in an X direction or a Y direction, wherein the X direction is defined by a width of the first platform and the Y direction is defined by a length of the first platform, and wherein the length of the first platform and the width of the first platform define a first rig floor plane with a Z axis being perpendicular to the first rig floor plane.

Embodiment 35

The system of embodiment 34, wherein the first platform comprises a first derrick extending from a first drill floor.

Embodiment 36

The system of embodiment 35, wherein the first derrick is adjusted relative to the first platform to correct an orientation of the first derrick having a center line that is offset from the Z axis, and wherein the first derrick is adjusted by at least 0.01 degrees, or 0.02 degrees, or 0.03 degrees, or 0.04 degrees, or 0.05 degrees, or 0.06 degrees, or 0.07 degrees, or 0.08 degrees, or 0.09 degrees, or 0.1 degrees, or 0.2 degrees, or 0.3 degrees, or 0.4 degrees, or 0.5 degrees, or 1 degree, or 2 degrees, or 3 degrees.

Embodiment 37

The system of embodiment 1, wherein the second platform is configured to move in an X direction or a Y direction, wherein the X direction is defined by a width of the second platform and the Y direction is defined by a length of the second platform, and wherein the length of the second platform and the width of the second platform define a second rig floor plane with a Z axis being perpendicular to the second rig floor plane, and wherein the second platform comprises a second derrick extending from a second drill floor.

Embodiment 38

The system of embodiment 37, wherein the second derrick is adjusted relative to the second platform to correct an orientation of the second derrick having a center line that is offset from the Z axis, and wherein the second derrick is adjusted by at least 0.01 degrees, or 0.02 degrees, or 0.03 degrees, or 0.04 degrees, or 0.05 degrees, or 0.06 degrees, or 0.07 degrees, or 0.08 degrees, or 0.09 degrees, or 0.1 degrees, or 0.2 degrees, or 0.3 degrees, or 0.4 degrees, or 0.5 degrees, or 1 degree, or 2 degrees, or 3 degrees.

Embodiment 39

A method for performing a subterranean operation, the method comprising:

positioning a rig at a first desired location, the rig comprising a first platform coupled to a substructure and a second platform coupled to the substructure; and locating the second platform at a desired distance from the first platform with the first platform being moveable relative to the second platform.

Embodiment 40

The method of embodiment 39, wherein the locating further comprises moving the first platform relative to the second platform such that the first platform is the desired distance from the second platform.

Embodiment 41

The method of embodiment 40, wherein the locating further comprises moving the first platform relative to the substructure.

Embodiment 42

The method of embodiment 41, wherein the locating further comprises moving the second platform relative to the first platform and the substructure.

Embodiment 43

The method of embodiment 42, wherein moving the first platform comprises moving the first platform in an X direction or a Y direction, wherein the X direction is defined by a width of the first platform and the Y direction is defined by a length of the first platform, and wherein the length and the width of the first platform define a first rig floor plane.

Embodiment 44

The method of embodiment 43, wherein the moving the first platform comprises moving the first platform relative to the substructure in the X direction for a distance of at least 0.5% of the width of the first platform, or at least 1%, or 2%, or 3%, or 4%, or 5%, or 8%, or 10%, or 12%, or 14%, or 16%, or 18%, or 20%, or 25%, or 30%, or 35%, or 40%, or 45%, or 50%, or 55%, or 60%, or 65%, or 70%, or 75%, or 80%, or 85%, or 90%, or 95%, or 100% of the width of the first platform.

Embodiment 45

The method of embodiment 44, wherein the moving the first platform comprises moving the first platform relative to the substructure in the X direction for a distance of less than 200% of the width of the first platform, or less than 180%, or 150%, or 120%, or 100%, or 90%, or 80%, or 70%, or 60%, or 50%, or 40%, or 30%, or 20%, or 10% of the width of the first platform.

Embodiment 46

The method of embodiment 44, wherein the moving the first platform comprises moving the first platform relative to the substructure in the X direction for a distance of at least 0.01 m, or 0.1 m, or 0.5 m, or 1 m, or 1.5 m, or 2 m, or 2.5 m, or 3 m, or 3.5 m, or 4 m, or 4.5 m.

Embodiment 47

The method of embodiment 43, wherein the moving the first platform comprises moving the first platform relative to the substructure in the Y direction for a distance of at least 0.1% of the length of the first platform, or at least 0.2%, or 0.3%, or 0.4%, or 0.5%, or 0.6%, or 0.7%, or 0.8%, or 0.9%, or 1%, or 1.5%, or 2%, or 2.5%, or 3%, or 3.5%, or 4%, or 5%, or 6%, or 7%, or 8%, or 9%, or 10% of the length of the first platform.

Embodiment 48

The method of embodiment 47, wherein the moving the first platform comprises moving the first platform relative to the substructure in the Y direction for a distance of less than 40% of the length of the first platform, or less than 38%, or 35%, or 32%, or 30%, or 27%, or 25%, or 22%, or 20%, or 18%, or 15%, or 12%, or 10%, or 9%, or 8%, or 7%, or 6%, or 5%, or 4%, or 3%, or 2%, or 1% of the length of the first platform.

Embodiment 49

The method of embodiment 47, wherein the moving the first platform comprises moving the first platform relative to the substructure in the Y direction for a distance of at least 0.01 m, or 0.1 m, or 0.2 m, or 0.3 m, or 0.4 m, or 0.5 m, or 0.6 m, or 0.7 m, or 0.8 m, or 0.9 m, or 1 m, or 1.2 m, or 1.5 m, or 1.8 m, or 2 m, or 2.2 m, or 2.4 m, or 2.6 m, or 2.8 m, or 3 m.

Embodiment 50

The method of embodiment 43, wherein moving the second platform comprises moving the second platform in an X direction or a Y direction, wherein the X direction is defined by a width of the second platform and the Y direction is defined by a length of the second platform, and wherein the length and the width of the second platform define a second rig floor plane.

Embodiment 51

The method of embodiment 50, wherein the moving the second platform comprises moving the second platform relative to the substructure in the X direction for a distance of at least 0.5% of the width of the second platform, or at least 1%, or 2%, or 3%, or 4%, or 5%, or 8%, or 10%, or 12%, or 14%, or 16%, or 18%, or 20%, or 25%, or 30%, or 35%, or 40%, or 45%, or 50%, or 55%, or 60%, or 65%, or 70%, or 75%, or 80%, or 85%, or 90%, or 95%, or 100% of the width of the second platform.

Embodiment 52

The method of embodiment 51, wherein the moving the second platform comprises moving the second platform relative to the substructure in the X direction for a distance of less than 200% of the width of the second platform, or less than 180%, or 150%, or 120%, or 100%, or 90%, or 80%, or 70%, or 60%, or 50%, or 40%, or 30%, or 20%, or 10% of the width of the second platform.

Embodiment 53

The method of embodiment 51, wherein the moving the second platform comprises moving the second platform relative to the substructure in the X direction for a distance of at least 0.01 m, or 0.1 m, or 0.5 m, or 1 m, or 1.5 m, or 2 m, or 2.5 m, or 3 m, or 3.5 m, or 4 m, or 4.5 m.

Embodiment 54

The method of embodiment 43, wherein the moving the second platform comprises moving the second platform relative to the substructure in the Y direction for a distance of at least 0.1% of the length of the second platform, or at least 0.2%, or 0.3%, or 4%, or 0.5%, or 0.6%, or 0.7%, or 0.8%, or 0.9%, or 1%, or 1.5%, or 2%, or 2.5%, or 3%, or 3.5%, or 4%, or 5%, or 6%, or 7%, or 8%, or 9%, or 10% of the length of the second platform.

Embodiment 55

The method of embodiment 54, wherein the moving the second platform comprises moving the second platform relative to the substructure in the Y direction for a distance of less than 40% of the length of the second platform, or less than 38%, or 35%, or 32%, or 30%, or 27%, or 25%, or 22%, or 20%, or 18%, or 15%, or 12%, or 10%, or 9%, or 8%, or 7%, or 6%, or 5%, or 4%, or 3%, or 2%, or 1% of the width of the second platform.

Embodiment 56

The method of embodiment 54, wherein the moving the second platform comprises moving the second platform relative to the substructure in the Y direction for a distance of at least 0.01 m, or 0.1 m, or 0.2 m, or 0.3 m, or 0.4 m, or 0.5 m, or 0.6 m, or 0.7 m, or 0.8 m, or 0.9 m, or 1 m, or 1.2 m, or 1.5 m, or 1.8 m, or 2 m, or 2.2 m, or 2.4 m, or 2.6 m, or 2.8 m, or 3 m.

Embodiment 57

The method of embodiment 43, wherein the first platform comprises a first well center and the second platform comprises a second well center, and wherein the locating further comprises locating the first well center away from the second well center a distance equal to a wellbore spacing by moving one or both of the first platform and the second platform relative to the substructure.

Embodiment 58

The method of embodiment 57, wherein the moving the rig to the first desired location comprises: establishing a first wellbore location based on a position of the first well center over a subterranean formation; and performing, via the first platform, a first subterranean operation at the first wellbore location.

Embodiment 59

The method of embodiment 58, further comprising: moving the rig to a second desired location; and aligning the second well center with the first wellbore location by moving the second platform relative to the substructure.

Embodiment 60

The method of embodiment 59, further comprising:

performing, via the second platform, a second subterranean operation at the first wellbore location;

establishing a second wellbore location based on a position of the first well center over the subterranean formation at the second desired location of the rig; and performing, via the first platform, a third subterranean operation at the second wellbore location.

Embodiment 61

The method of embodiment 60, further comprising: moving the rig to a third desired location; and aligning the second well center with the second wellbore location by moving the second platform relative to the substructure;

performing, via the second platform, a fourth subterranean operation at the second wellbore location;

establishing a third wellbore location based on a position of the first well center over the subterranean formation at the third desired location of the rig; and performing, via the first platform, a fifth subterranean operation at the third wellbore location.

Embodiment 62

The method of embodiment 61, further comprising: repeating operations of embodiment 26 with the moving the rig comprising moving the rig to a next desired location to produce a line of wellbores, with adjacent wellbores being spaced apart by +/− 10% of the wellbore spacing.

Embodiment 63

The method of embodiment 61, wherein the first subterranean operation is a drilling operation that drills a first wellbore at the first wellbore location.

Embodiment 64

The method of embodiment 63, wherein the second subterranean operation is a casing operation that runs casing in the first wellbore at the first wellbore location.

Embodiment 65

The method of embodiment 64, wherein the third subterranean operation is a drilling operation that drills a second wellbore at the second wellbore location.

Embodiment 66

The method of embodiment 65, wherein the fourth subterranean operation is a casing operation that runs casing in the second wellbore at the second wellbore location.

While the present disclosure may be susceptible to various modifications and alternative forms, specific embodiments have been shown by way of example in the drawings and tables and have been described in detail herein. However, it should be understood that the embodiments are not intended to be limited to the particular forms disclosed. Rather, the disclosure is to cover all modifications, equivalents, and alternatives falling within the spirit and scope of the disclosure as defined by the following appended claims. Further, although individual embodiments are discussed herein, the disclosure is intended to cover all combinations of these embodiments.

The invention claimed is:

1. A system for performing a subterranean operation, the system comprising:

a substructure of a rig comprising an upper support structure, a lower support structure, and a plurality of supports rotationally coupled between the upper support structure and the lower support structure and configured to move from a first position to a second position;

a first platform overlying and coupled to the substructure; and a second platform overlying and coupled to the substructure, the second platform being different than the first platform, wherein each of the first platform and the second platform is configured to move independently from and relative to the substructure.

2. The system of claim 1, wherein the first platform is configured to move independently from and relative to the second platform, and wherein the second platform is configured to move independently from and relative to the first platform.

3. The system of claim 1, wherein movement of the substructure from the first position to the second position includes movement of the first platform and the second platform together.

4. The system of claim 1, wherein the first platform and the second platform are configured to move in an X direction or a Y direction or combinations thereof, wherein the X direction is defined by a width of the first platform and the Y direction is defined by a length of the first platform, wherein the length of the first platform and the width of the first platform define a first rig floor plane, and wherein a length of the second platform and a width of the second platform define a second rig floor plane.

5. The system of claim 4, wherein the first platform is configured to move relative to the substructure in the X direction for a distance of at least 0.5% of the width of the first platform and less than 200% of the width of the first platform, wherein the second platform is configured to move relative to the substructure in the X direction for a distance of at least 0.5% of the width of the second platform and less than 200% of the width of the second platform, and wherein the first platform and the second platform are configured to move relative to the substructure in the X direction for a distance of at least 0.01 m.

6. The system of claim 4, wherein the first platform is configured to move relative to the substructure in the Y direction for a distance of at least 0.1% of the length of the first platform and less than 40% of the length of the first platform, and wherein the second platform is configured to move relative to the substructure in the Y direction for a distance of at least 0.1% of the length of the second platform and less than 40% of the length of the second platform.

7. The system of claim 4, wherein the first platform and the second platform are configured to move relative to the substructure in the Y direction for a distance of at least 0.01 m.

8. The system of claim 1, further comprising: a first drive system coupled between the upper support structure of the substructure and the first platform, wherein the first drive system is configured to move the first platform from a first position to a second position; and a second drive system coupled between the upper support structure of the substructure and the second platform with the second drive system being different than the first drive system, wherein the second drive system is configured to move the second platform from a third position to a fourth position, and wherein the first drive system and the second drive system are configured to actuate separately from each other.

9. The system of claim 8, wherein the first drive system and the second drive system comprise actuators that are electrical, electro-mechanical, magnetic, electromagnetic, hydraulic, pneumatic, or combinations thereof.

10. The system of claim 9, wherein each of the first drive system and the second drive system comprises 1) one or more hydraulic actuators coupled between the first platform and the substructure, or 2) a cable and pulley system with motors driving the cables through a pulley system, or 3) a screw-type drive system coupled between the first platform and the substructure, or 4) a rack and pinion moving system, or 5) combinations thereof, to move the first platform and the second platform, respectively, relative to the substructure.

11. The system of claim 1, wherein the first platform comprises a first well center and the second platform comprises a second well center, and wherein a distance between the first and second well centers is adjustable by one of:

movement of the first platform relative to the substructure, movement of the second platform relative to the substructure, and movement of both the first and second platforms relative to the substructure.

12. The system of claim 1, wherein the first platform and the second platform are configured to move in an X direction or a Y direction, wherein the X direction is defined by a width of the first platform and the Y direction is defined by a length of the first platform, wherein the length of the first platform and the width of the first platform define a first rig floor plane with a Z axis being perpendicular to the first rig floor plane, wherein the first platform comprises a first derrick extending from a first drill floor, and wherein the second platform comprises a second derrick extending from a second drill floor.

13. The system of claim 12, wherein the first derrick is configured to be adjusted relative to the first platform to correct an orientation of the first derrick having a center line that is offset from the Z axis, and wherein the first derrick is configured to be adjusted by at least 0.01 degrees, and wherein the second derrick is configured to be adjusted relative to the second platform to correct an orientation of the second derrick having a center line that is offset from the Z axis, and wherein the second derrick is configured to be adjusted by at least 0.01 degrees.

14. A method for performing a subterranean operation, the method comprising:

positioning a rig at a first desired location, the rig comprising a substructure having an upper support structure, a lower support structure, and a plurality of supports rotationally coupled between the upper support structure and the lower support structure, and the rig further comprising a first platform coupled to the substructure and a second platform coupled to the substructure; and locating the first platform at a desired distance from the second platform by moving the first platform or the second platform relative to the substructure.

15. The method of claim 14, wherein locating the first platform at the desired distance from the second platform comprises one of:

moving the first platform relative to the second platform such that the first platform is the desired distance from the second platform;

moving the second platform relative to the first platform;

moving the first platform relative to the substructure;

moving the second platform relative to the substructure; or moving the first and second platforms relative to the substructure.

16. The method of claim 14, wherein moving the first platform comprises moving the first platform in an X direction, or a Y direction, or a Z-direction, or combinations thereof, wherein the X direction is defined by a width of the first platform, the Y direction is defined by a length of the first platform, wherein the length and the width of the first platform defines a first rig floor plane, wherein a Z-direction is generally perpendicular to the first rig floor plane, and wherein moving the second platform comprises moving the second platform in the X direction, or the Y direction, or the Z-direction, or combinations thereof.

17. The method of claim 14, wherein the first platform comprises a first well center and the second platform comprises a second well center, and wherein the locating further comprises locating the first well center away from the second well center a distance equal to a wellbore spacing by moving one or both of the first platform and the second platform relative to the substructure.

18. The method of claim 17, wherein the moving the rig to the first desired location comprises:

establishing a first wellbore location based on a position of the first well center over a subterranean formation;

performing, via the first platform, a first subterranean operation at the first wellbore location;

moving the rig to a second desired location; and aligning the second well center with the first wellbore location by moving the second platform relative to the substructure.

19. The method of claim 18, further comprising:

performing, via the second platform, a second subterranean operation at the first wellbore location;

establishing a second wellbore location based on a position of the first well center over the subterranean formation at the second desired location of the rig; and performing, via the first platform, a third subterranean operation at the second wellbore location;

moving the rig to a third desired location;

aligning the second well center with the second wellbore location by moving the second platform relative to the substructure;

performing, via the second platform, a fourth subterranean operation at the second wellbore location;

establishing a third wellbore location based on a position of the first well center over the subterranean formation at the third desired location of the rig; and performing, via the first platform, a fifth subterranean operation at the third wellbore location.

20. The method of claim 19, further comprising:

repeating operations of moving the rig successively to a series of next desired locations and performing the first, second, third, and fourth subterranean operations to produce a line of wellbores, with adjacent wellbore being spaced apart substantially by a wellbore spacing, wherein the first subterranean operation is a drilling operation that drills a first wellbore at the first wellbore location, wherein the second subterranean operation is a casing operation that runs casing in the first wellbore at the first wellbore location, wherein the third subterranean operation is a drilling operation that drills a second wellbore at the second wellbore location, and wherein the fourth subterranean operation is a casing operation that runs casing in the second wellbore at the second wellbore location.

* * * * *